US009469459B2

(12) United States Patent
Strominger

(10) Patent No.: US 9,469,459 B2
(45) **Date of Patent: *Oct. 18, 2016**

(54) LID FOR A BEVERAGE CUP INCLUDING A SNACK STORAGE RESERVOIR

(71) Applicant: Bonnie Sussman Strominger, New York, NY (US)

(72) Inventor: Bonnie Sussman Strominger, New York, NY (US)

(73) Assignee: Crazy Minds LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/990,071

(22) Filed: Jan. 7, 2016

(65) Prior Publication Data

US 2016/0114959 A1 Apr. 28, 2016

Related U.S. Application Data

(63) Continuation of application No. 14/986,117, filed on Dec. 31, 2015, which is a continuation-in-part of application No. 14/295,754, filed on Jun. 4, 2014, which is a continuation-in-part of application No. 13/911,777, filed on Jun. 6, 2013.

(60) Provisional application No. 61/657,235, filed on Jun. 8, 2012.

(51) Int. Cl.

| | |
|---|---|
| ***B65D 81/32*** | (2006.01) |
| ***B65D 51/28*** | (2006.01) |
| ***B65D 1/26*** | (2006.01) |
| ***B65D 21/02*** | (2006.01) |

(52) U.S. Cl.

CPC ..... *B65D 81/3205* (2013.01); *B65D 1/265* (2013.01); *B65D 21/0209* (2013.01); *B65D 21/0228* (2013.01); *B65D 51/28* (2013.01); *B65D 2231/022* (2013.01)

(58) Field of Classification Search

CPC ..... B65D 2231/022; B65D 51/28; B65D 81/3205

USPC ..... 220/709

See application file for complete search history.

(56) References Cited

U.S. PATENT DOCUMENTS

| | | | |
|---|---|---|---|
| 4,770,318 | A | 9/1988 | Earl |
| 4,955,503 | A | 9/1990 | Propes |

(Continued)

*Primary Examiner* — Shawn M Braden

(74) *Attorney, Agent, or Firm* — Baker & Hostetler LLP

(57) ABSTRACT

A lid for a beverage cup includes: (a) a radial collar configured to engage with a rim of a drinking cup mouth, having an inner radial surface and an outer radial surface; (b) an outer reservoir wall extending axially upward from the outer surface of the radial collar and enclosing a reservoir chamber above the radial collar, and including an upper rim; (c) a reservoir floor extending radially inward from an upper end of the inner surface of the radial collar and substantially closing the reservoir chamber from below the reservoir floor, the floor including a fluid path opening providing at least part of a fluid path extending upward through the reservoir chamber, the fluid path opening being positioned along a first diametrical line extending through the reservoir chamber; (d) an inner wall separating the fluid path from the reservoir chamber substantially in the shape of an upside-down funnel extending upward from the floor, having a minor diameter extending above a vertical level of the upper rim of the outer reservoir wall to form a spout; and (e) a cap connected to the upper rim of the outer wall with a first living hinge and including a first segment with a hole adapted to receive the spout.

18 Claims, 24 Drawing Sheets

(56) References Cited

U.S. PATENT DOCUMENTS

| | | | | |
|---|---|---|---|---|
| 5,137,210 | A | 8/1992 | Hibbs | |
| 5,180,079 | A * | 1/1993 | Jeng | A47G 19/065 206/217 |
| D467,499 | S | 12/2002 | Garza et al. | |
| D480,968 | S | 10/2003 | Atkins et al. | |
| 7,111,748 | B2 * | 9/2006 | Cha | A47G 19/065 220/4.27 |
| 7,676,909 | B2 | 3/2010 | MacKenzie et al. | |
| 7,882,991 | B2 | 2/2011 | Schechter | |
| 8,631,957 | B2 | 1/2014 | Dart et al. | |
| 8,708,181 | B2 * | 4/2014 | Buck | A47G 19/065 220/253 |
| 2008/0073415 | A1 | 3/2008 | Kuighadush | |
| 2008/0099494 | A1 | 5/2008 | Boukais et al. | |
| 2011/0210126 | A1 * | 9/2011 | Vovan | A47G 19/06 220/574 |
| 2012/0168329 | A1 | 7/2012 | Berggren | |
| 2012/0168440 | A1 * | 7/2012 | Nerswick | B65D 47/06 220/212 |
| 2012/0273500 | A1 | 11/2012 | Yao | |
| 2013/0001233 | A1 | 1/2013 | Hylton | |
| 2013/0056463 | A1 | 3/2013 | Buck | |
| 2013/0228486 | A1 | 9/2013 | Buck | |

* cited by examiner

LID FOR A BEVERAGE CUP INCLUDING A SNACK STORAGE RESERVOIR

CROSS-REFERENCE TO RELATED APPLICATIONS

This application is a continuation application from U.S. application Ser. No. 14/986,117, filed Dec. 31, 2015, which is a continuation-in-part of U.S. application Ser. No. 14/295,754, filed Jun. 4, 2014, which is a continuation-in-part of U.S. application Ser. No. 13/911,777, filed on Jun. 6, 2013, which claims priority from provisional application U.S. Application Ser. No. 61/657,235, filed on Jun. 8, 2012, entitled Beverage Cup with Snack Storage, the entire contents of each of which are expressly incorporated herein in their entirety by reference.

TECHNICAL FIELD

The present disclosure is in the technical field of snack storage technology. More particularly, the present disclosure is in the technical field of snack storage technology, wherein a snack storage container is useable in connection with a beverage container such that the combinations of the two, as a unit, are capable of holding beverages and foods separately and simultaneously in one combination snack and beverage unit. Other aspects of the present disclosure include a snack storage container that is resealable, detachable, and may include a covering or lid that never needs to be removed. In addition, some embodiments allow a user to store multiple snacks without intermixing therebetween. Some or all of the features disclosed herein may contribute to the disclosed product making it user friendly, versatile, sanitary, and reusable.

BACKGROUND

In the past, there have been patents related to apparatuses capable of holding a beverage and food or two beverages simultaneously in the same unit. The previously disclosed technologies include, but are not limited to: a beverage cup with an attached side pouch for food (Hibbs, U.S. Pat. No. 5,137,210); partitioned cups for two beverages or a beverage and a food (Propes, U.S. Pat. No. 4,955,503; Cha, U.S. Pat. No. 7,111,748; Jeng, U.S. Pat. No. 5,180,079); et al.

SUMMARY

The present disclosure relates to a lid that may be adapted to be seated on a drinking cup, a soda can, bottle or other drinking dispenser that contains a snack/food reservoir accessible by a user holding the drinking cup/dispensor. The present disclosure, for example, allows a consumer to hold both a beverage and food in one hand thus enabling free usage of the opposite hand. The present disclosure puts a new twist on an age old pastime of snacking, drinking and entertainment. The multiple designs provided by this disclosure help to alleviate issues that can occur in virtually any arena, i.e. walking, talking on cell, sporting events, amusement parks, theatres, and individuality to allow an individual to create their own combination of snacks and beverages by filling the unit with the components desired by the individual, i.e. various empty designs being sold to mass retailers for the home as well.

Various novel aspects of the present disclosure may include the following. The snack container of the disclosure may universally mate with and/or clip to multiple industrystandard (and non-industry standard) beverage containers (i.e., 12 oz, 16 oz, 24 oz, 36 oz, 44 oz cups, et al.). In another novel aspect of the disclosure, the snack container may include threads on a bottom portion thereof for mating with corresponding threads on a beverage container. Smaller sizes of the snack container may be provided and marketed as suitable for use with "kids" products or "for kids."

Embodiments of the present disclosure are distinctive in that once the unit is initially filled with snacks and a beverage, the top lid of the unit does not need to be completely removed to access the snacks or beverage. Additionally, multiple embodiments of the present disclosure allow a user to access the snacks and beverage without having to completely remove the lid of the snack container. Different embodiments of the present disclosure may be targeted to different markets depending on their intended use, i.e. to be used with certain types of food/snacks and beverages or in certain environments.

In one embodiment, the present disclosure is comprised of a unit comprising a top portion to hold the snack(s). In this embodiment, the lid for the top portion may be opened to access the snacks by a turn style. In other embodiments the snack portion of the unit may be accessed by a flip top hinged lid.

The above disclosed embodiments can utilize any of the following mechanisms to access the beverage in the beverage portion of the cup. In some embodiments a straw may be utilized that passes through a portal on the lid, through the snack portion of the cup, through the barrier separating the food and beverage portions, and ultimately down into the beverage for sipping. Depending on the embodiment, the straw can pierce through the middle of the cup downwards, the end of the top lid, or pierce through the side of the upper portion of the beverage. The straw may be extra-long in length and bendable, created by multiple compositions of engineering. In alternative embodiments that do not utilize a straw, a sip spout feature that opens and closes is used to access the beverage portion of the cup.

As previously mentioned, the present disclosure comprises a barrier that separates the food container and beverage container portions of the unit. The configuration of the barrier may be dependent upon which variations are used to access the food in the snack portion and beverage in the beverage portion of the unit.

In an embodiment, the disclosure provides a lid for a beverage cup that includes: (a) a radial collar configured to engage with a rim of a drinking cup mouth, having an inner radial surface and an outer radial surface; (b) an outer reservoir wall extending axially upward from the outer surface of the radial collar and enclosing a reservoir chamber above the radial collar, and including an upper rim; (c) a reservoir floor extending radially inward from an upper end of the inner surface of the radial collar and substantially closing the reservoir chamber from below the reservoir floor, the floor including a fluid path opening providing at least part of a fluid path extending upward through the reservoir chamber, the fluid path opening being positioned along a first diametrical line extending through the reservoir chamber; (d) an inner wall separating the fluid path from the reservoir chamber; and (e) a cap connected to the upper rim of the outer reservoir wall along a first living hinge having a first hinge axis positioned a first distance S from a center the fluid path opening, the cap further including a second living hinge having a second hinge axis running parallel to the first hinge axis and positioned distal from the first hinge axis at a distance greater than the first distance S, the second hinge axis separating a fluid path segment of the cap from a reservoir segment of the cap; where the fluid path segment of the cap includes a fluid path hole, at least part of which is on the first diametrical line and at a distance S from the first hinge axis; and where the fluid path segment of the cap includes a coupling that retains the fluid path segment of the cup and the second living hinge over the upper rim, and retains the fluid path hole over the fluid path when the fluid path segment is closed onto the upper rim. Therefore, in such an embodiment, when the fluid path segment of the cap is retained on the upper rim, the reservoir segment of the cap can pivot on the second living hinge to selectively provide access to the reservoir chamber thereunder.

In a more detailed embodiment, inner radial surface has an axial height that is equal to or larger than an axial height of a beaded rim of a drinking cup mouth. Alternatively, or in addition, the radial collar includes one or more radially inwardly extending protrusions for engaging with an under surface of a beaded rim of a drinking cup mouth to form a friction fit there-between. Alternatively, or in addition, the upper rim includes at least one radially inwardly or outwardly extending flange.

Alternatively, or in addition, the inner wall is substantially in the shape of an upside-down funnel extending upward from the floor. In a further detailed embodiment the upside-down funnel has a minor diameter extending above a vertical level of the upper rim of the outer reservoir wall to form a spout. In a further detailed embodiment, the spout has a diameter sufficient to provide a friction fit with the fluid path hole when the spout is received within the fluid path hole. Alternatively, or in addition, the spout includes an x-shaped cutout for receiving a drinking straw therethrough or the spout includes a drinking hole at a top surface thereof.

Alternatively, or in addition, the cap includes a friction fit coupling that retains the fluid path segment of the cup and the second living hinge over the upper rim. In a further detailed embodiment, the friction fit coupling includes the fluid path hole. In a further detailed embodiment, the inner wall is substantially in the shape of an upside-down funnel extending upward from the floor, having a minor diameter extending above a vertical level of the upper rim of the outer reservoir wall to form a spout; and the spout has a diameter sufficient to provide a friction fit coupling with the fluid path hole when the spout is received within the fluid path hole.

Alternatively, or in addition, the first and second hinge axes are substantially perpendicular to the first diametrical line. Alternatively, or in addition, the reservoir segment of the cap includes a post and/or an indentation for providing friction fit coupling with a complimentary indentation and/or post provided at the upper rim of the outer reservoir wall when the lid is pivoted down to a closed position. In a further detailed embodiment, the reservoir segment includes a cylindrical post for providing a friction fit coupling with a complimentary indentation provided on a flange extending from the upper rim of the outer reservoir wall.

Alternatively, or in addition, the reservoir segment is pivotable, when the fluid path segment is retained on the upper rim, between (a) a closed position that is seated on the upper rim of the outer reservoir wall closing off the reservoir chamber there-beneath and (b) an open position in which the reservoir segment is positioned substantially perpendicular to the reservoir segment allowing access to the reservoir chamber.

In an embodiment, the disclosure provides for a lid for a beverage cup that includes: (a) a radial collar configured to engage with a rim of a drinking cup mouth, having an inner radial surface and an outer radial surface; (b) an outer reservoir wall extending axially upward from the outer surface of the radial collar and enclosing a reservoir chamber above the radial collar, and including an upper rim; (c) a reservoir floor extending radially inward from an upper end of the inner surface of the radial collar and substantially closing the reservoir chamber from below the reservoir floor, the floor including a fluid path opening providing at least part of a fluid path extending upward through the reservoir chamber, the fluid path opening being positioned along a first diametrical line extending through the reservoir chamber; (d) an inner wall separating the fluid path from the reservoir chamber substantially in the shape of an upside-down funnel extending upward from the floor, having a minor diameter extending above a vertical level of the upper rim of the outer reservoir wall to form a spout; and (e) a cap connected to the upper rim of the outer wall with a first living hinge and including a first segment with a hole adapted to receive the spout. In a detailed embodiment, the cap includes a second segment connected to the first segment by a second living hinge and adapted to be pivotable to selectively provide access to the reservoir chamber. In an embodiment, all the components are molded as a unitary thermoformed unit.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope. The disclosure will be described with additional specificity and detail through use of the accompanying drawings.

In the drawings.

DETAILED DESCRIPTION

Figure 1:
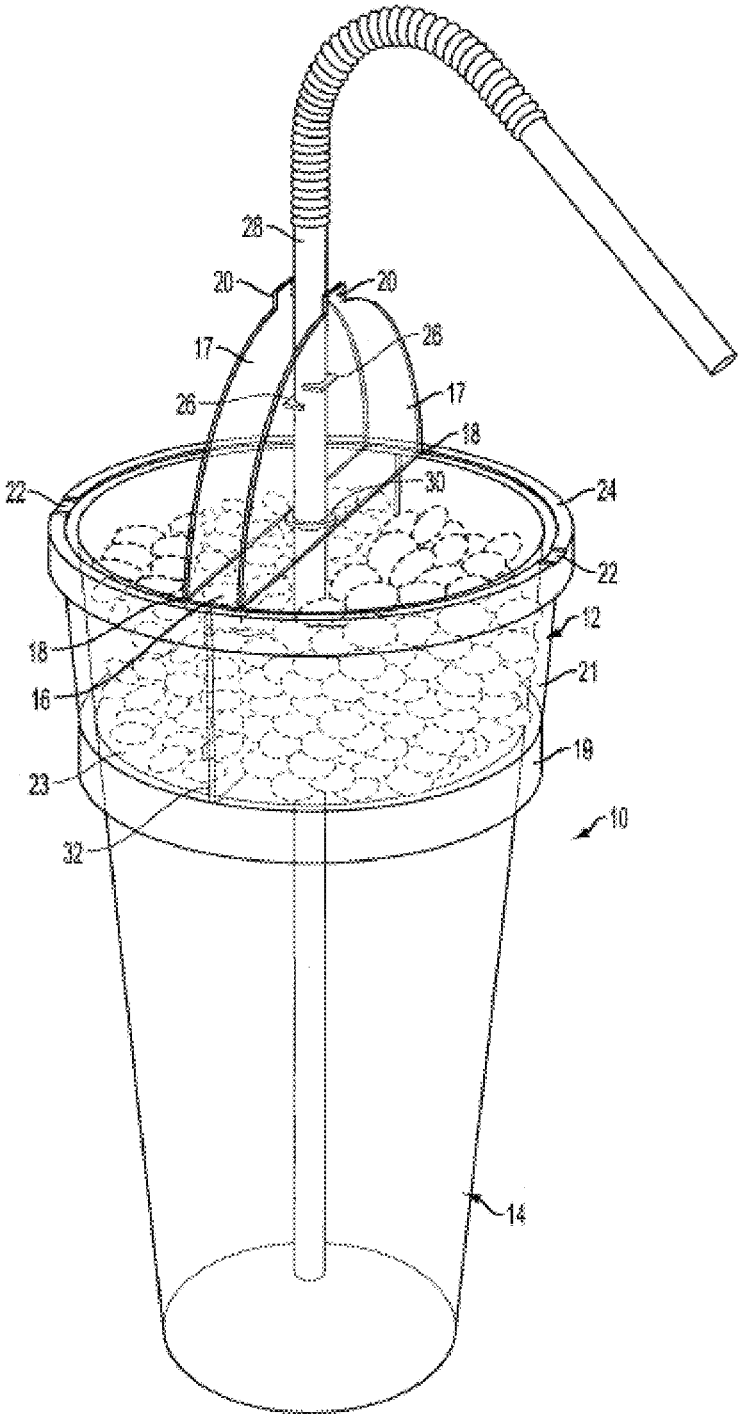
FIG. 1 is a transparent, perspective view of a combination snack container and beverage container incorporated into a single unit in accordance with aspects of the present disclosure having dual hinged lids depicted in an open position.
Figure 2:
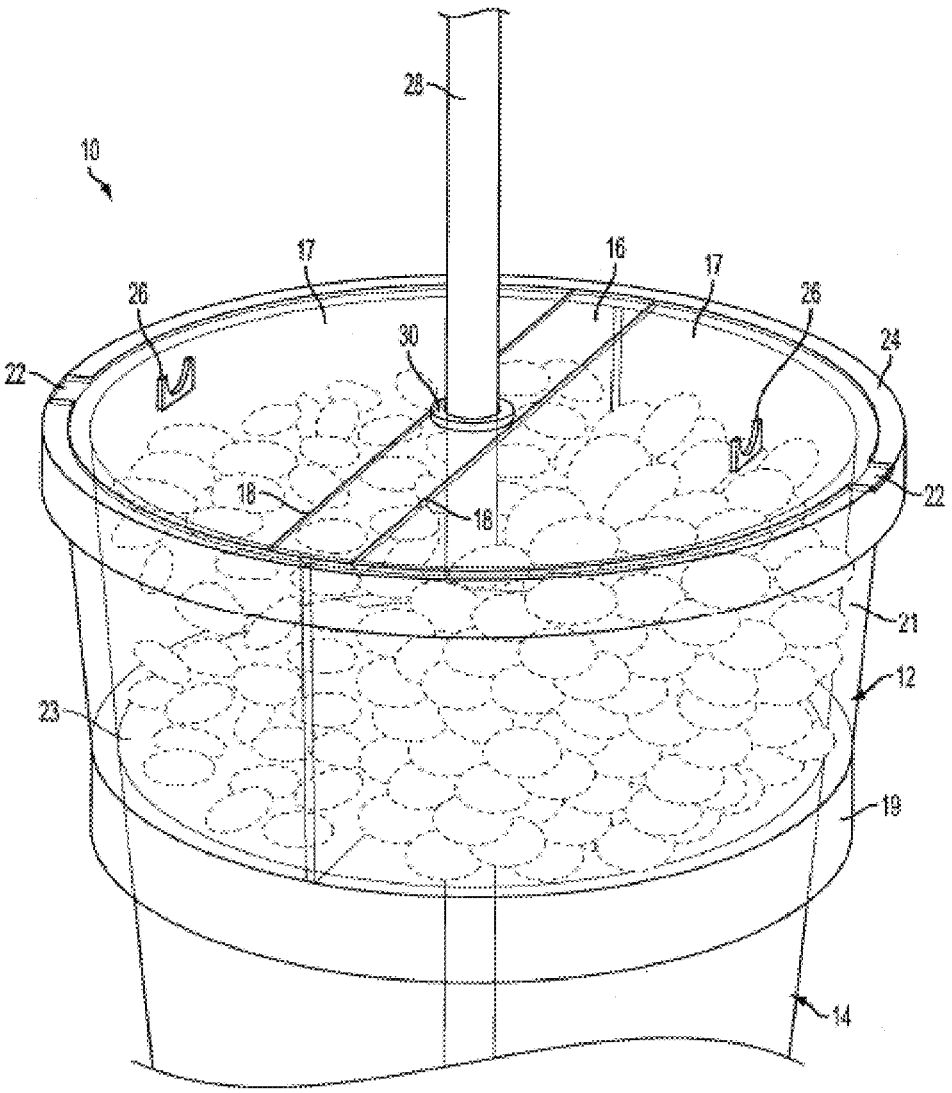
FIG. 2 is a close-up transparent, perspective view of the combination snack container and beverage container of FIG. 1 having dual hinged lids depicted in a closed position.

As shown best in FIGS. 1 and 2, an embodiment of the present disclosure is directed to a snack and beverage unit 10 comprised of a snack container 12 and a beverage container 14. In aspects of the disclosure, the snack container 12 may include a dual lid 16, having dual lid portions 17, a beverage container engaging portion 19 shaped to engage a rim portion of a beverage container 14, at least one sidewall 21, and a floor 23. The dual lid portions 17 may be hinged to the lid 16 by hinges 18 allowing the dual lid portions 17 to pivot between open and closed positions. The dual lid portions 17 may also include tabs 20 on an outer periphery thereof which are shaped and sized to be received in corresponding friction fit slots 22 located on a rim edge 24 of the snack container 12. Preferably, the tabs 20 are slightly larger than the friction fit slots 22 so that they may be frictionally received therein in a snap-type fit.

In aspects of this embodiment, the dual lid portions 17 may include snap-fit clips 26 thereon that are shaped and sized to snap onto a straw 28. While such clips 26 may be of any design, preferably such clips 26 are shaped in a semi-circle configuration to provide an interference snap-type fit on straw 28. The clips 26 allow a user of the unit 10 to keep the lid portions 17 open to allow access to snacks in the snack container 12 as desired. In an embodiment, such as disclosed in FIGS. 1 and 2, wherein dual lid portions 17 are utilized, the clips 26 may be staggered on the lid portions 17 to prevent the clips 26 from interfering with each other when engaging the straw 28. The lid 16 may preferably be provided with an ingress opening 30 to provide an entry for the straw 28 through the lid, through an egress opening (not shown) and into the beverage container 14. In an embodiment of the disclosure, the snack container 12 may be provided with a partition 32 to allow a user of the snack container 12 to place two different snacks in the snack container 12 while simultaneously preventing intermixing thereof.

Figure 3:
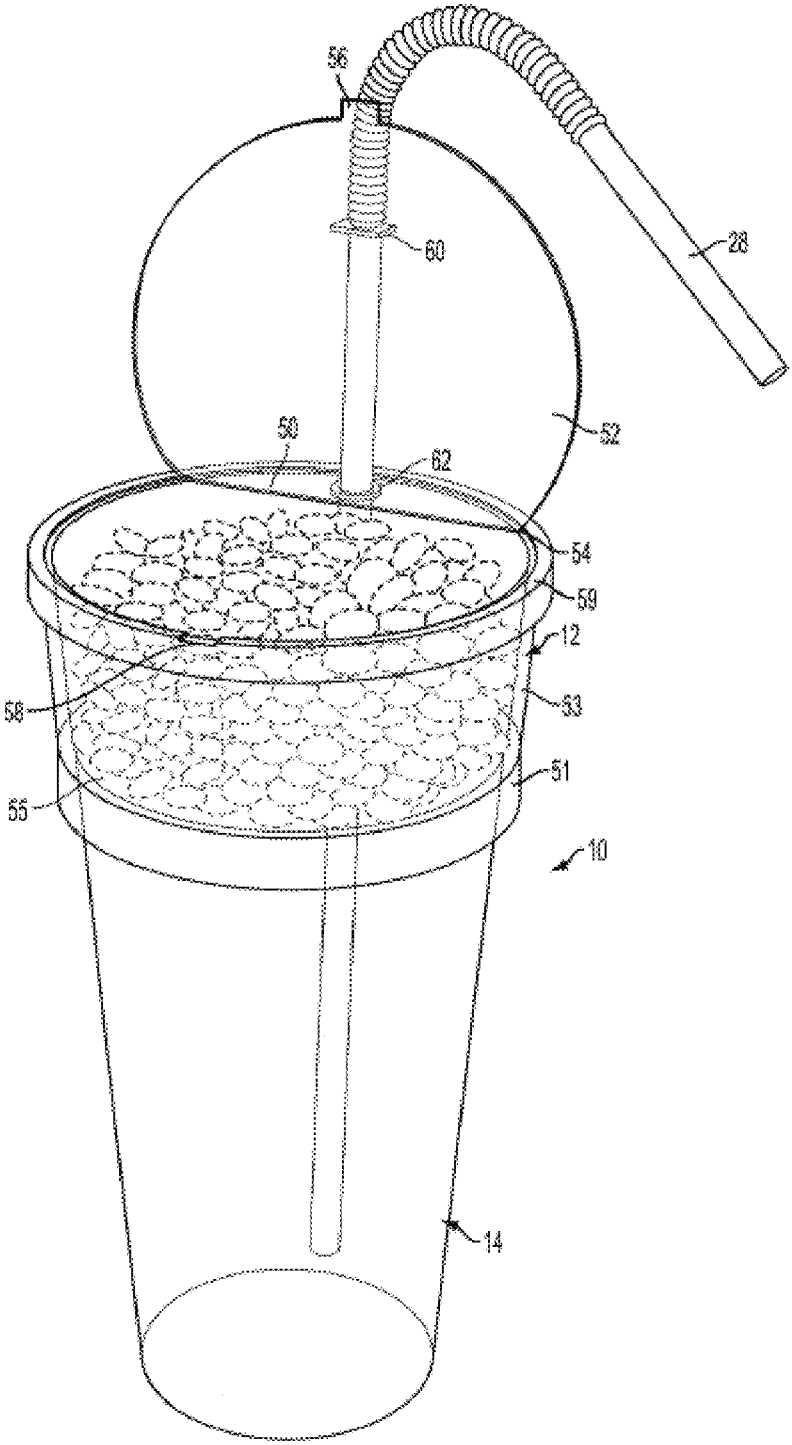
FIG. 3 is a transparent, perspective view of an alternate embodiment of a combination snack container and beverage container incorporated into a single unit in accordance with aspects of the present disclosure having a single hinged lid depicted in an open position.
Figure 4:
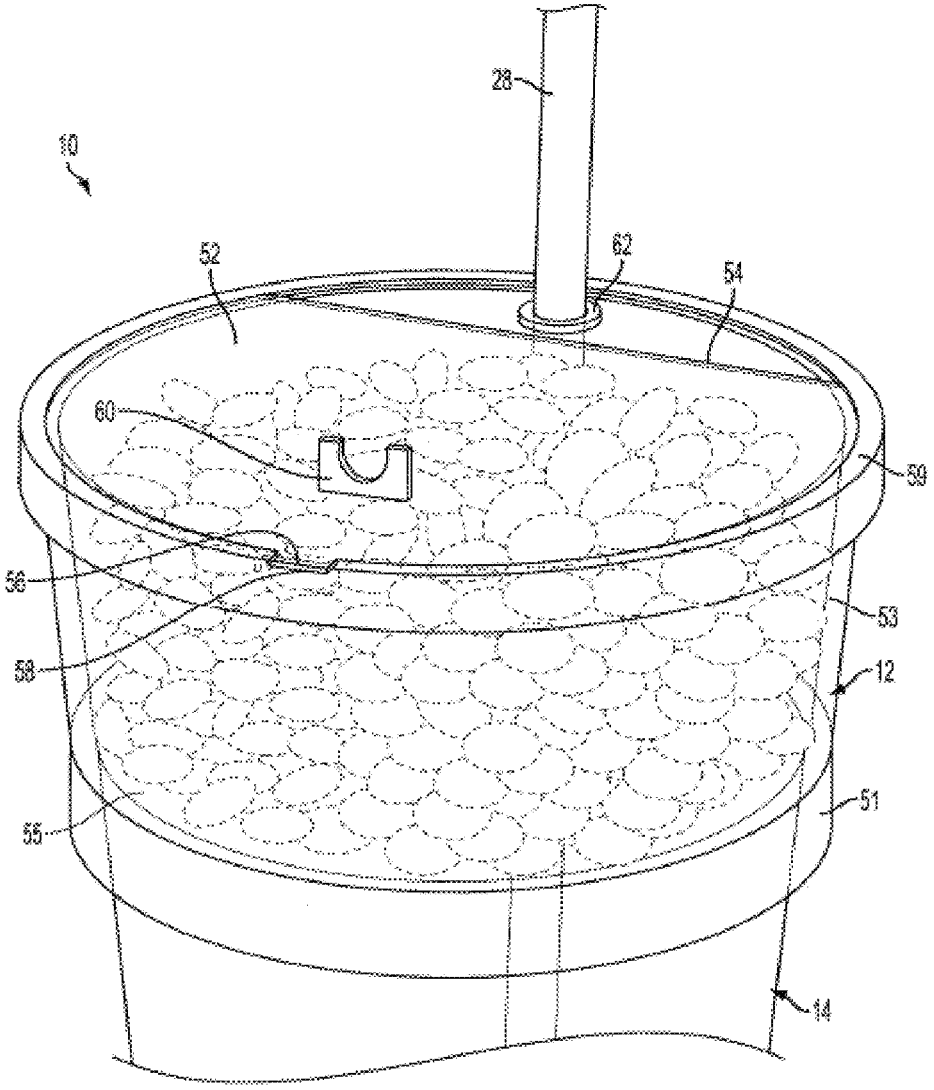
FIG. 4 is a close-up transparent, perspective view of the combination snack container and beverage container of FIG. 3 having a single hinged lid depicted in a closed position.

In aspects of the disclosure as shown best in FIGS. 3. and 4, the snack container 12 may include a single lid 50, having a single lid portion 52, a beverage container engaging portion 51 shaped to engage a rim portion of a beverage container 14, at least one sidewall 53, and a floor 55. The single lid portion 52 may be hinged to the lid 50 by hinge 54 allowing the lid portion 52 to pivot between open and closed positions. The lid portions 52 may also include tab 56 on an outer periphery thereof which is shaped and sized to be received in a corresponding friction fit slot 58 located on a rim edge 59 of the snack container 12. Preferably, the tab 56 is slightly larger than the friction fit slot 58 so that it may be frictionally received therein in a snap-type fit.

In aspects of this embodiment, the single lid portion 52 may include a snap-fit clip 60 thereon that is shaped and sized to snap onto the straw 28. While such a clip 60 may be of any design, preferably such clip 60 is shaped in a semi-circle configuration to provide an interference snap-type fit on straw 28. The clip 60 allows a user of the unit 10 to keep the lid portion 52 open to allow access to snacks in the snack container 12 as desired. The lid 50 may preferably be provided with an ingress opening 62 to provide an entry for the straw 28 through the lid 50, through an egress opening (not shown) and into the beverage container 14.

Figure 5:
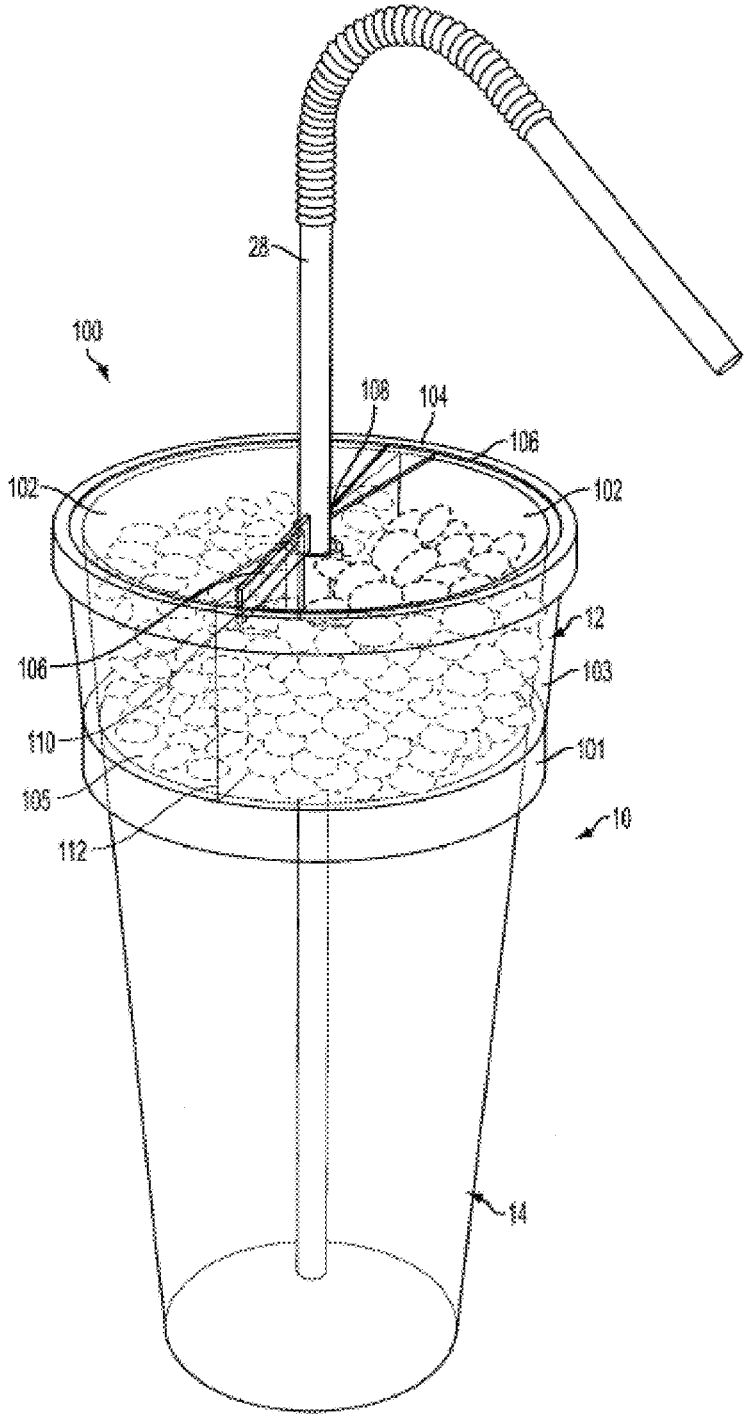
FIG. 5 is a transparent, perspective view of an alternate embodiment of a combination snack container and beverage container incorporated into a single unit in accordance with aspects of the present disclosure having a turn-style lid depicted in a partially closed position.
Figure 6:
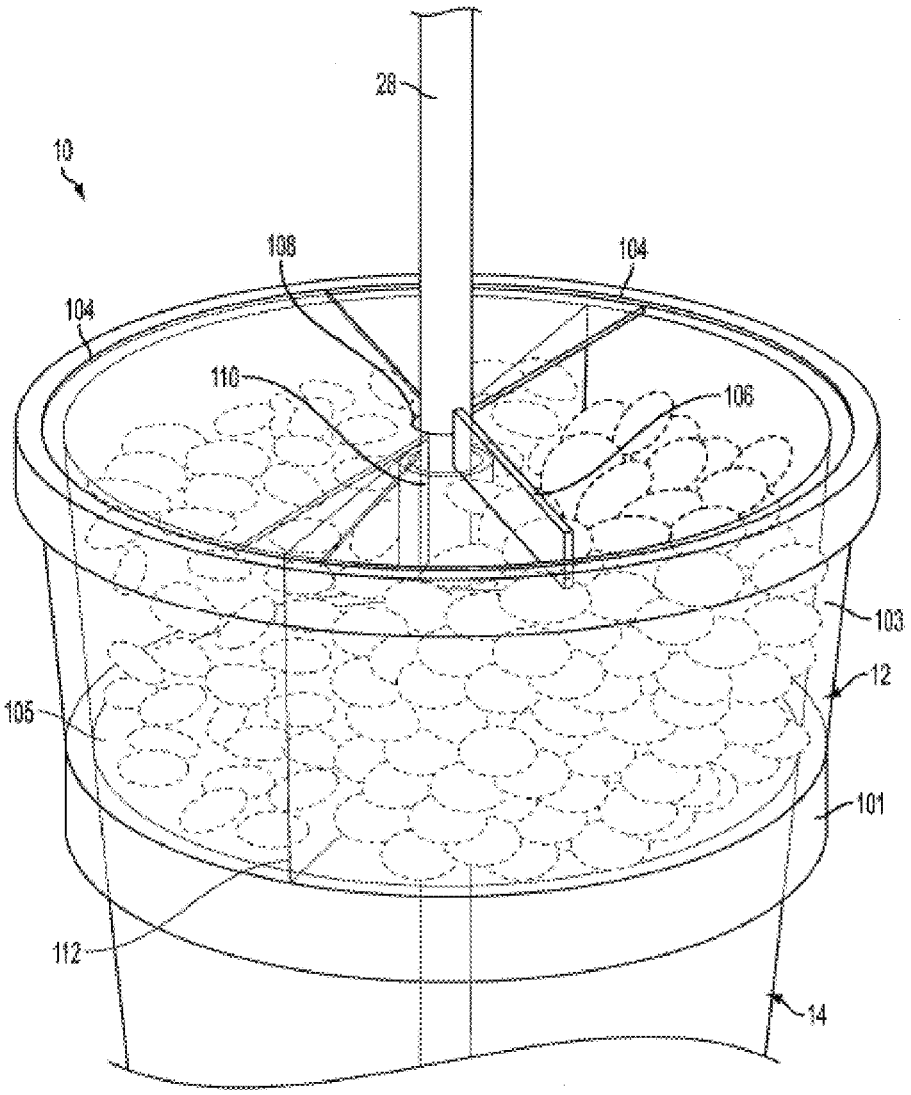
FIG. 6 is a close-up transparent, perspective view of the combination snack container and beverage container of FIG. 5 a having a turn-style lid depicted in a partially open position.

In aspects of the disclosure as shown best in FIGS. 5. and 6, the unit 10 may include a turn-style lid 100 comprised of two semi-circular lid portions 102 mounted one on top of the other for pivoting movement within corresponding slots 104 on the lid 100, a beverage container engaging portion 101 shaped to engage a rim portion of a beverage container 14, at least one sidewall 103, and a floor 105. The lid portions 102 may include a handle 106 to allow the user to more easily manipulate movement of the lid portions 102.

In aspects of this embodiment, the lid 100 may preferably be provided with an ingress opening 108 including a channel 110 through the snack container 12 to provide an entry for the straw 28, which may then proceed through an egress opening (not shown) and into the beverage container 14. In an embodiment of the disclosure, the snack container 12 may be provided with a partition 112 to allow a user of the unit 10 to place two different snacks in the snack container 12 while simultaneously preventing intermixing thereof.

Figure 7:
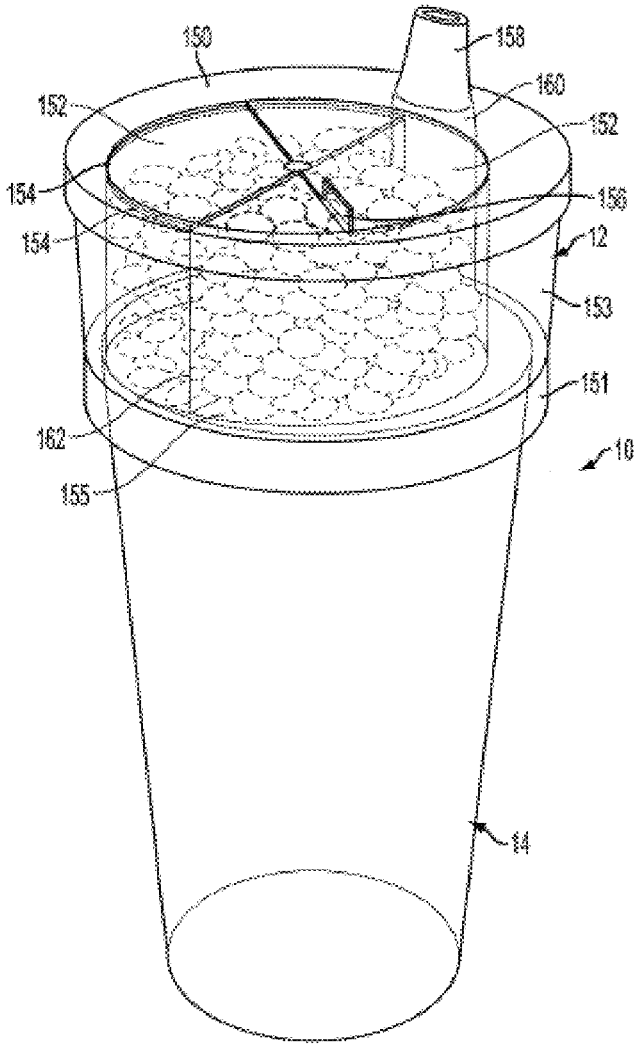
FIG. 7 is a transparent, perspective view of an alternate embodiment of a combination snack container and beverage container incorporated into a single unit in accordance with aspects of the present disclosure having a spout-style opening and a turn-style lid depicted in a closed position.
Figure 8:
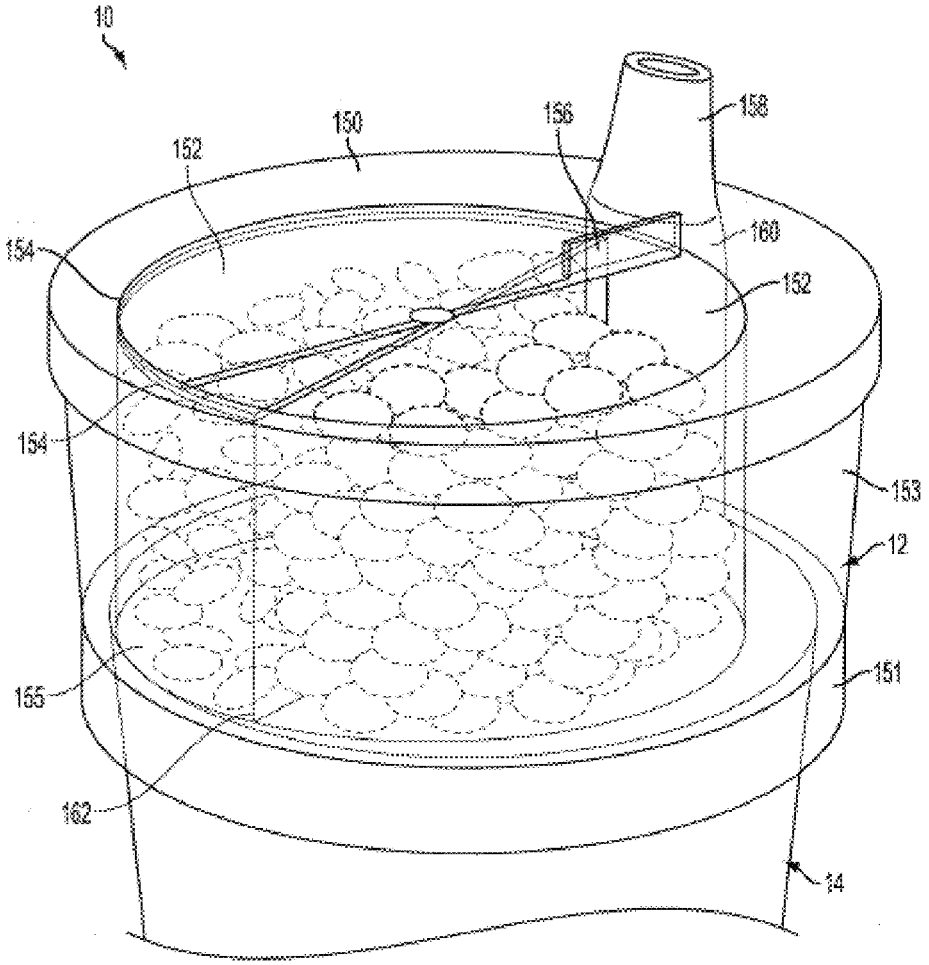
FIG. 8 is a close-up transparent, perspective view of the combination snack container and beverage container of FIG. 7 having a spout-style opening and a turn-style lid depicted in a partially closed position.

In aspects of the disclosure as shown best in FIGS. 7. and 8, the unit 10 may include a turn-style lid 150 including therein two semi-circular lid portions 152 mounted one on top of the other for pivoting movement within corresponding slots 154 on the lid 150, a beverage container engaging portion 151 shaped to engage a rim portion of a beverage container 14, at least one sidewall 153, and a floor 155. The lid portions 152 may include a handle 156 to allow the user to more easily manipulate movement of the lid portions 152.

In aspects of this embodiment, the lid 150 may preferably be provided with a spout 158 including a channel 160 through the snack container 12 to an egress opening (not shown) to provide access for a user to a beverage located in the beverage container 14. In an embodiment of the disclosure, the snack container 12 may be provided with a partition 162 to allow a user of the unit 10 to place two different snacks in the snack container 12 while simultaneously preventing intermixing thereof.

Figure 9:
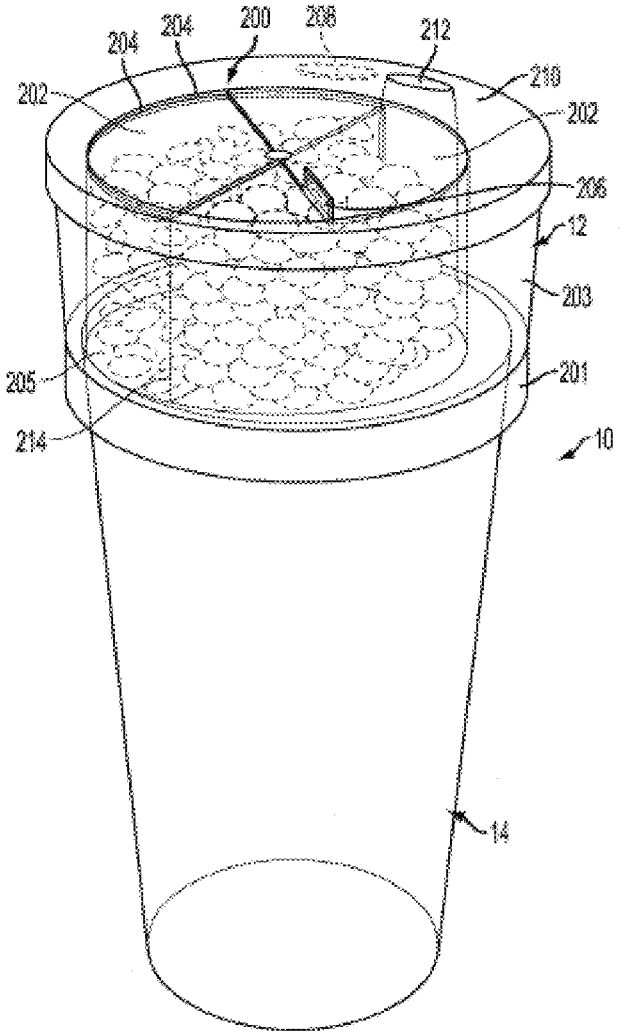
FIG. 9 is a transparent, perspective view of an alternate embodiment of a combination snack container and beverage container incorporated into a single unit in accordance with aspects of the present disclosure having a slit-style opening and a turn-style lid depicted in a closed snack and closed beverage position.

In aspects of the disclosure as shown best in FIGS. 9. and 10A and B, the unit 10 may include a turn-style lid 200 comprised of two semi-circular lid portions 202 mounted one on top of the other for pivoting movement within corresponding slots 204 on the lid 200, a beverage container engaging portion 201 shaped to engage a rim portion of a beverage container 14, at least one sidewall 203, and a floor 205. The lid portions 202 may include a handle 206 to allow the user to more easily manipulate movement of the lid portions 202.

Figure 10A:
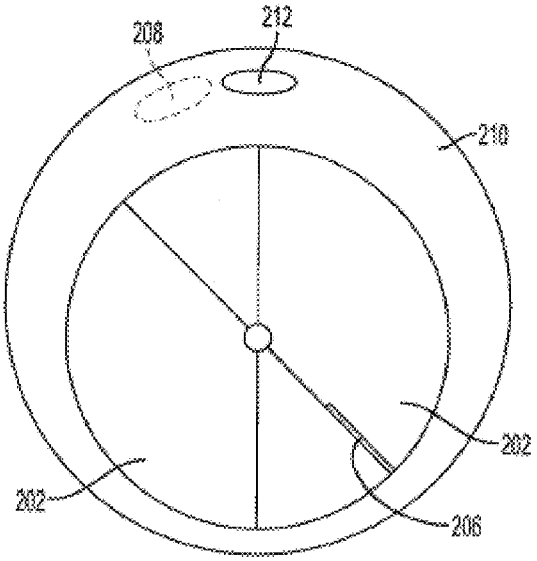
FIG. 10A is a top-plan view of the combination snack container and beverage container incorporated into a single unit of FIG. 9 depicted in an open snack and closed beverage position.
Figure 10B:
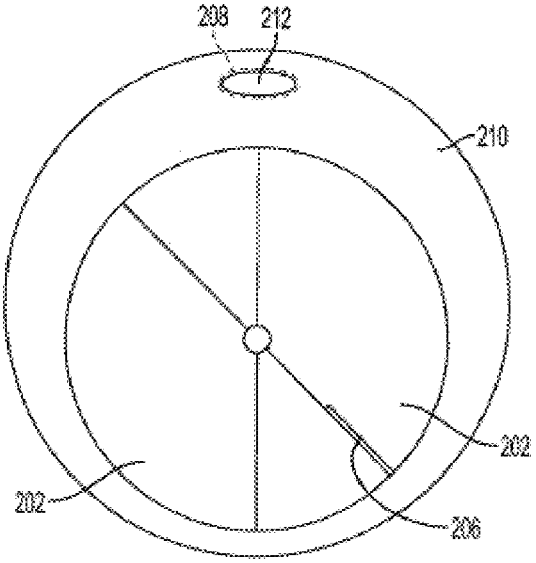
FIG. 10B is a top-plan view of the combination snack container and beverage container incorporated into a single unit of FIG. 9 depicted in an open snack and open beverage position.

In aspects of this embodiment, the lid 200 is mounted for rotational movement on the snack container 12. Accordingly, a slit 208 is preferably provided on the rim portion 210 of the lid 200 which is mounted for rotational movement on the snack container 12. A channel 212 is provided through the snack container 12 to an egress opening (not shown) to provide access for a user to a beverage located in the beverage container 14. Accordingly, as best shown in FIGS. 10A and 10B, a user can manipulate the lid 200 from a closed beverage configuration (FIG. 10A) to an open beverage configuration (FIG. 10B) by simply twisting the lid 200. In an embodiment of the disclosure, the snack container 12 may be provided with a partition 214 to allow a user of the unit 10 to place two different snacks in the snack container 12 while simultaneously preventing intermixing thereof.

Figure 11:
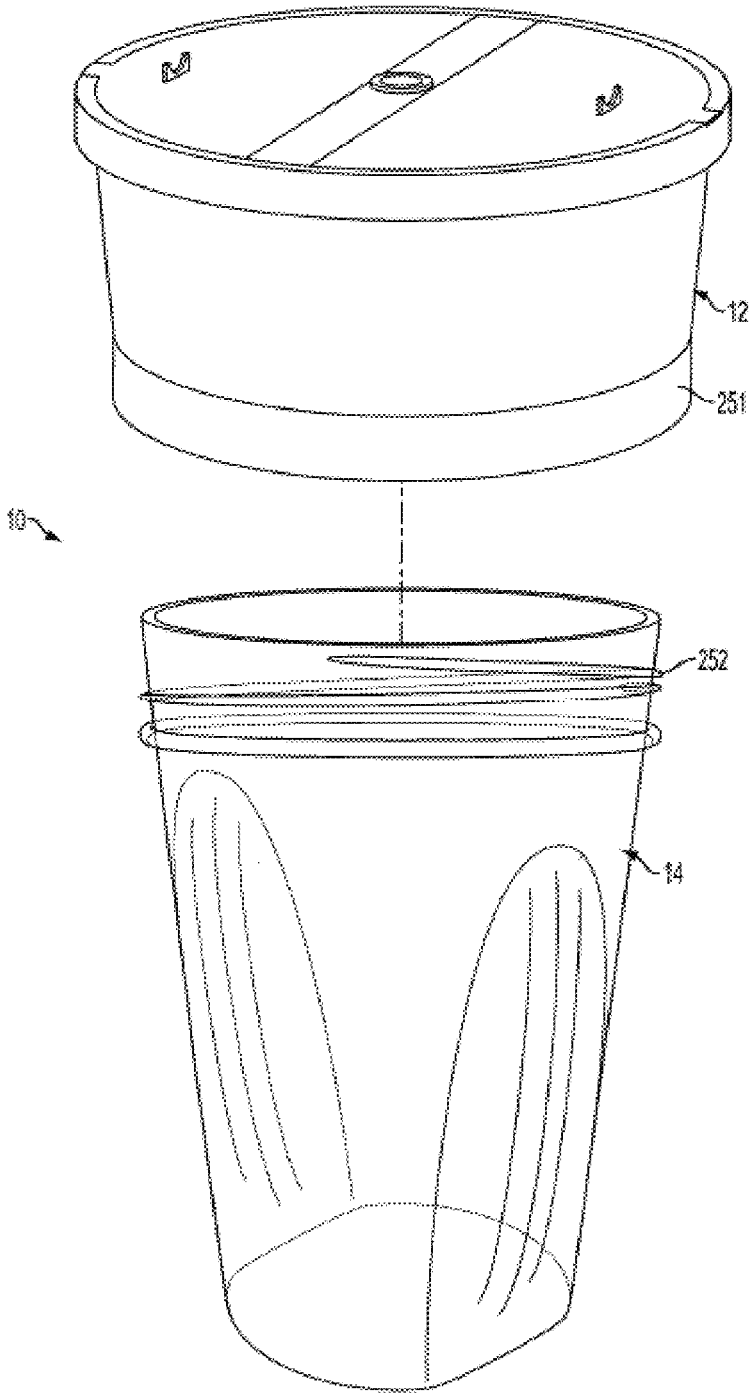
FIG. 11 is a is a transparent, perspective view of a combination snack container and beverage container incorporated into a single unit in accordance with aspects of the present disclosure showing a threaded beverage container shaped to be received by a snack container.
Figure 12:
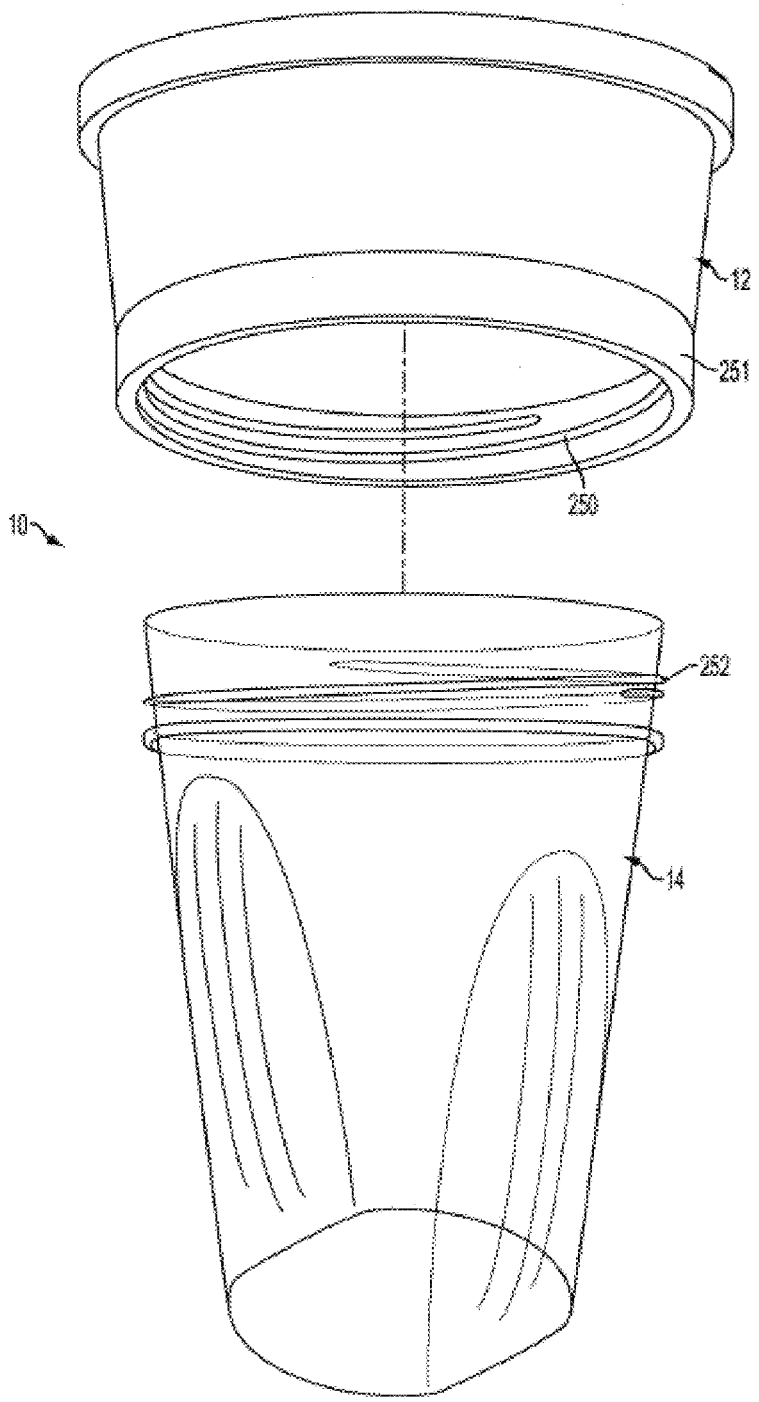
FIG. 12 is a is a transparent, perspective view of a combination snack container and beverage container incorporated into a single unit in accordance with aspects of the present disclosure showing a threaded beverage container shaped to be received by corresponding threads on a threaded snack container.

In aspects of the disclosure as shown best in FIGS. 11 and 12, the snack container 12 and beverage container 14 may be joined together by a threaded fit. Specifically, threads 250 on the beverage container engaging portion 251 of the snack container 12 may be shaped and sized to mate with corresponding threads 252 on the beverage container 14.

In aspects of the disclosure as shown above, the snack container may generally include a snack receiving portion, a lid, a beverage container engaging portion, at least one sidewall, a floor of the snack receiving portion, and a beverage egress. FIGS. 13-25 show alternate embodiments of the combined snack container and beverage container unit having aspects of the disclosure above. The features of the exemplary embodiments are described in greater detail below.

Figure 13:
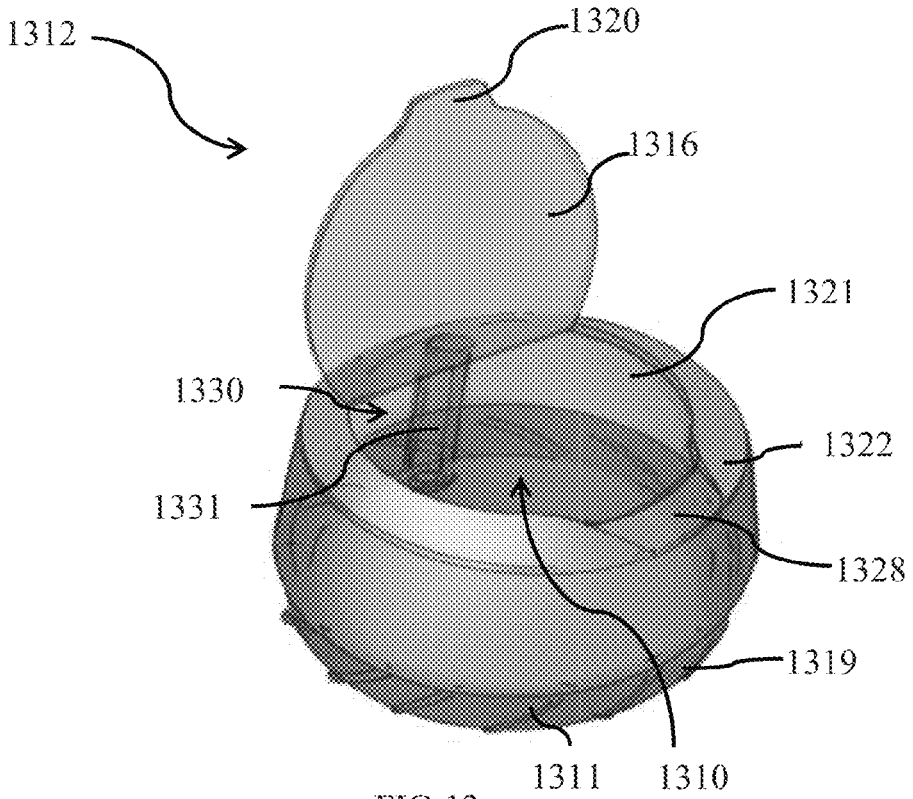
FIG. 13-21 are perspective views of various alternate embodiments of a combination snack container and beverage container incorporated into a single unit in accordance with aspects of the present disclosure, the embodiments having hinged lids depicted in an open position.

In the embodiment shown in FIG. 13, the combination snack and beverage unit 1312 includes a snack compartment 1310 and a beverage egress compartment 1330 separated therefrom by sidewall 1321. Beverage egress compartment 1330 includes a channel 1331 for guiding the insertion of a straw, and further prevents fluid communication between the snack compartment 1310 and a beverage compartment (not illustrated), minimizing any potential mixing of the snack and beverage. The upper rim of snack container 1312 may taper inward to form a lipped brim 1322, allowing for a notch 1328 that tab 1320 on lid 1316 may rest within. Ridges 1311 along the outer side of the beverage container engaging portion 1319 of unit 1312 may enhance a user's grip on the snack portion for removing or connecting to the beverage portion.

Figure 14:
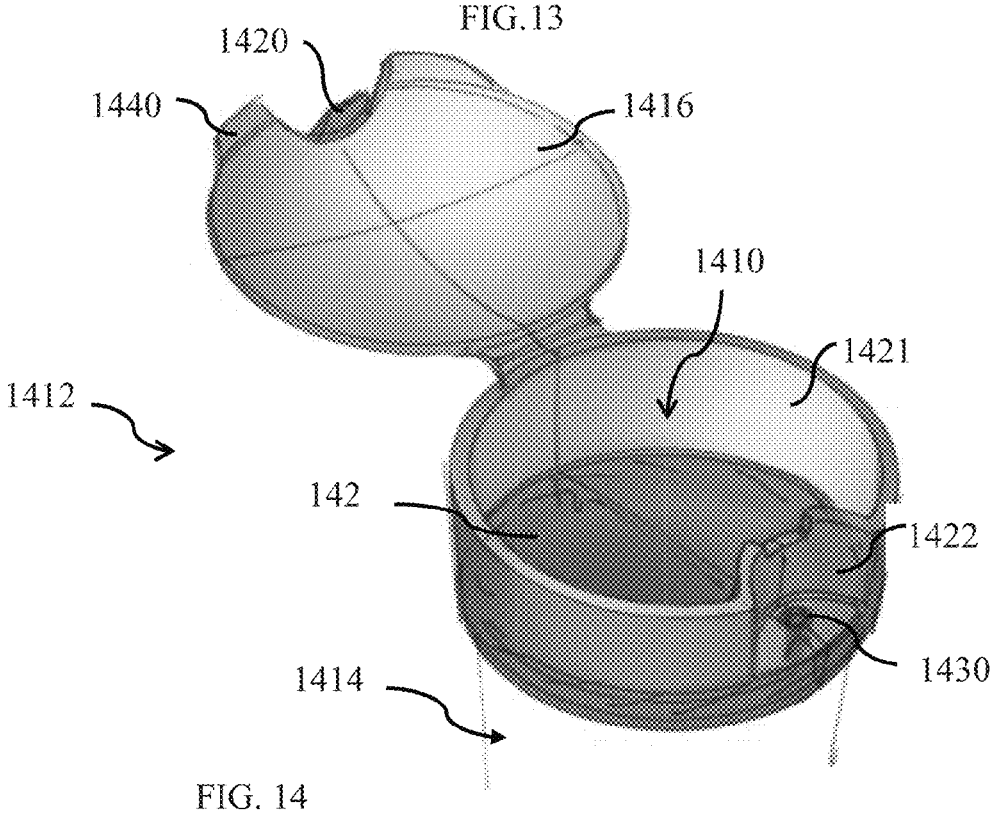

In the embodiment shown in FIG. 14, the combination snack and beverage unit 1412 includes a sidewall 1421 having an inwardly curved recession 1422 to separate a snack portion 1410 from an egress 1430 to the beverage container. Egress 1430 may include a hole 1430 allowing a straw (not shown) to enter the beverage portion 1414 through floor 1423 of snack container 1412. A lid 1416 may include a biased tab 1420 to lock lid 1416 to sidewall 1421 of snack container 1410, and may further include flanges 1440 for easy manipulation. In the embodiment shown, the lid 1416 opening is located at the same side as beverage egress 1430.

Figure 15:
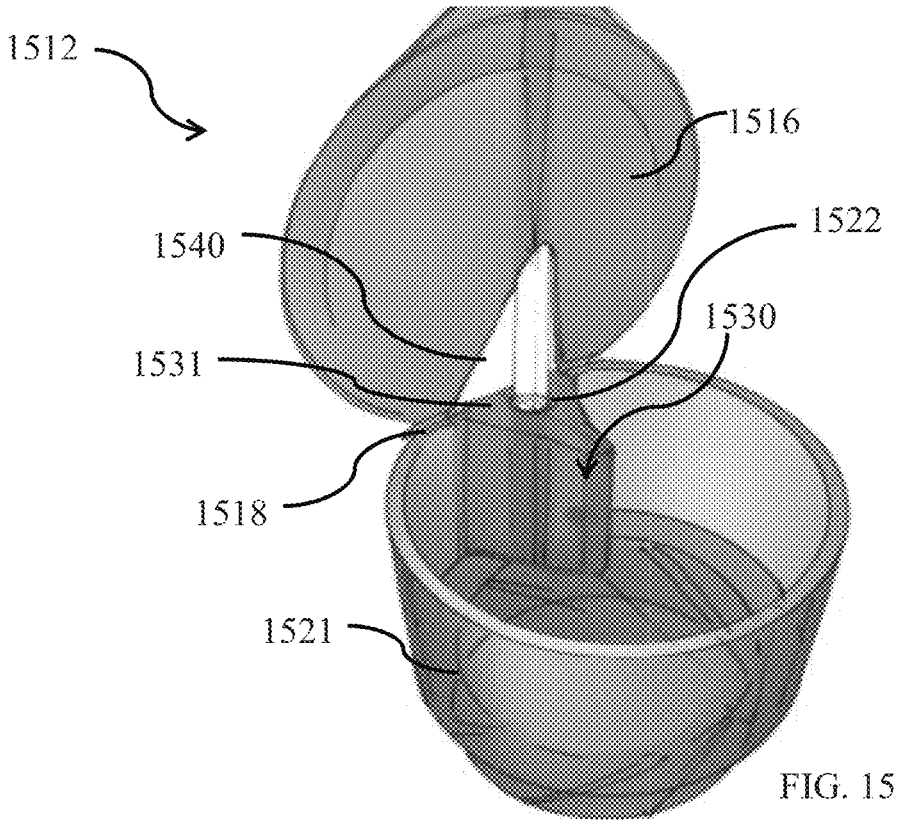

As shown in the embodiment of FIG. 15, the combination snack and beverage unit 1512 may include a beverage egress compartment 1530 abutted by sidewalls 1521 to take a triangular shape. Roof 1531 of the egress compartment 1530 may be flush with the snack container lid 1516, and include a cutout 1522 for a straw to access the beverage compartment (not illustrated). Because of the placement of beverage egress compartment 1530 and hinges 1518, lid cut-out 1540 allows the lid to open unhindered by the straw.

Figure 16:
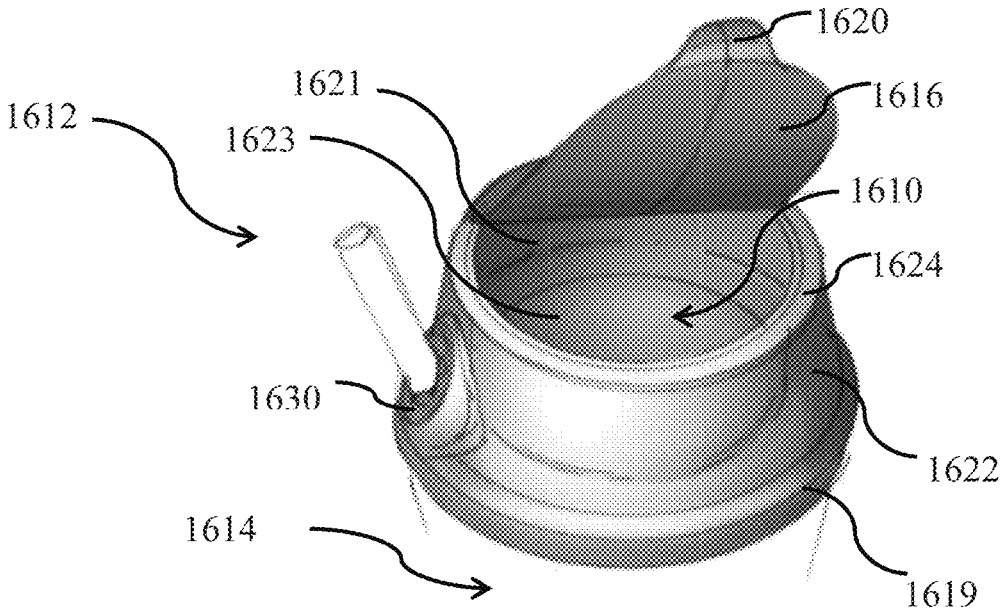

The embodiment shown in FIG. 16 of the combination snack and beverage unit 1612 includes an inner sidewall 1621 suspended from the upper rim 1624 of an outer sidewall 1622, which converge to share an upper rim 1624. A snack container 1610 defined by the inner sidewall 1621 and a floor 1623 may be initially sealed by a flexible lid 1616 removably glued or otherwise adhered to rim 1624. Lid 1616 may be peeled away from rim 1624 to allow access to the interior of snack container 1610. Lid 1616 may include a tab 1620 on its periphery to facilitate the peeling of lid 1616 by a user. A beverage container engaging rim 1619 and an egress 1630 to the beverage container portion 1614 may be located at outer sidewall 1621.

Figure 17:
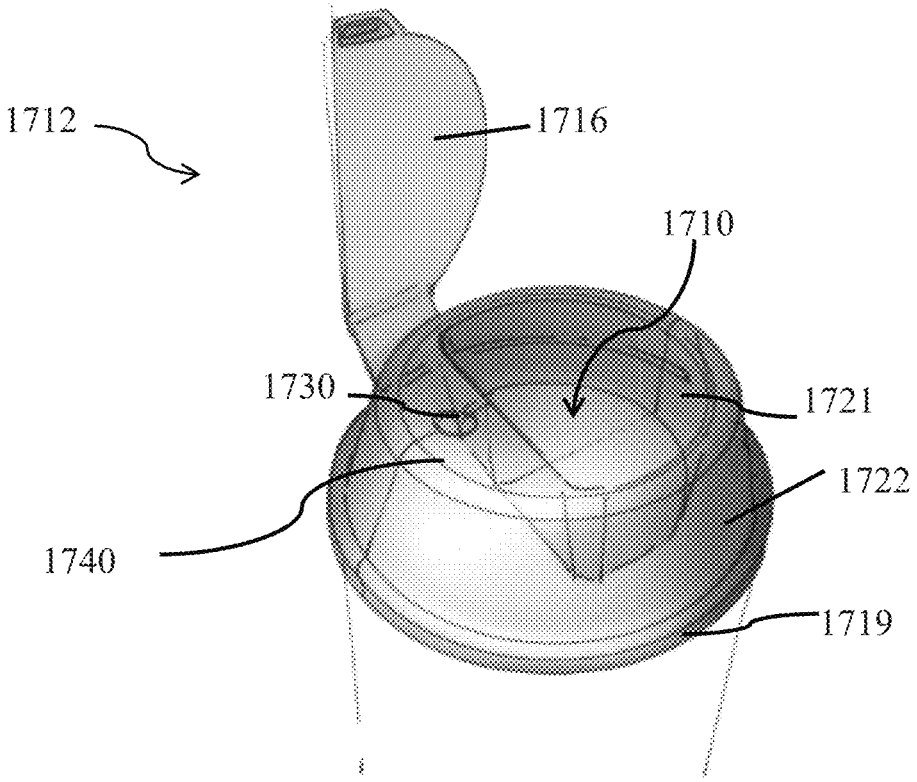

The embodiment shown in FIG. 17 of the combination snack and beverage unit 1712 includes an outer sidewall 1722 having beverage container engaging rim 1719, and a roof 1740. Roof 1740 includes a beverage egress 1730, shown as an opening, for the insertion of a straw. A snack container 1710 is formed as an indention suspended from a roof 1740 defined by an inner sidewall 1721 and floor 1723. A hinged lid 1716 attached to rim 1716 removably seals snack container 1710.

Figure 18:
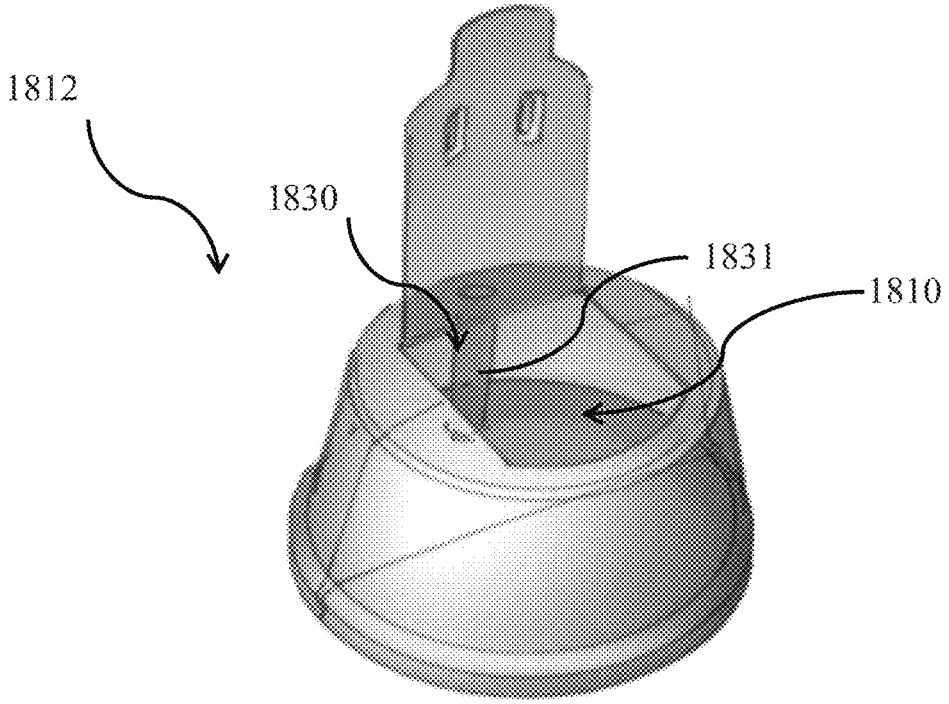

The embodiment of FIG. 18 of the combination snack and beverage unit 1812 includes a beverage egress 1830 having "doughnut hole" configured channel 1831 extending through the snack container 1810, providing fluid communication between the beverage container (not shown) and the ambient air. A straw (not shown) may be inserted through channel 1831.

Figure 19:
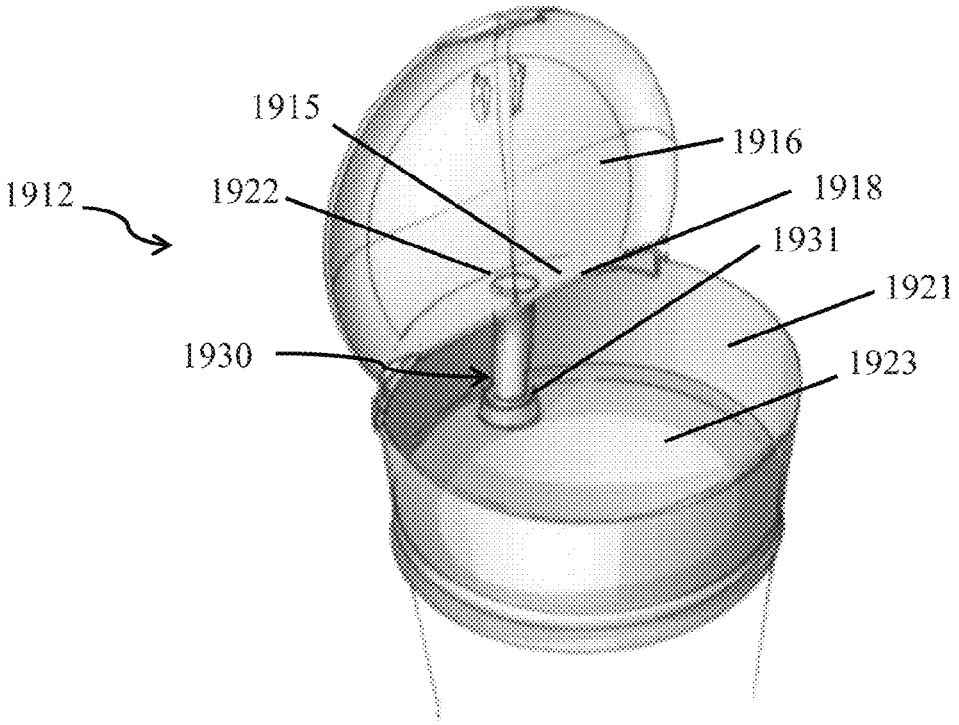

The embodiment of FIG. 19 of the combination snack and beverage unit 1912 includes a hinged lid 1916, and a beverage egress 1930 adjacent to sidewall 1921. Beverage egress 1930 includes a flanged orifice 1931 on snack portion floor 1923, and corresponding upper orifice 1922 on lid 1916, both sized to receive a straw (not shown) therethrough. The upper orifice 1922 is located on a fixed portion 1915 of the lid 1916 to avoid the straw interfering with the opening of the lid 1916.

Figure 20:
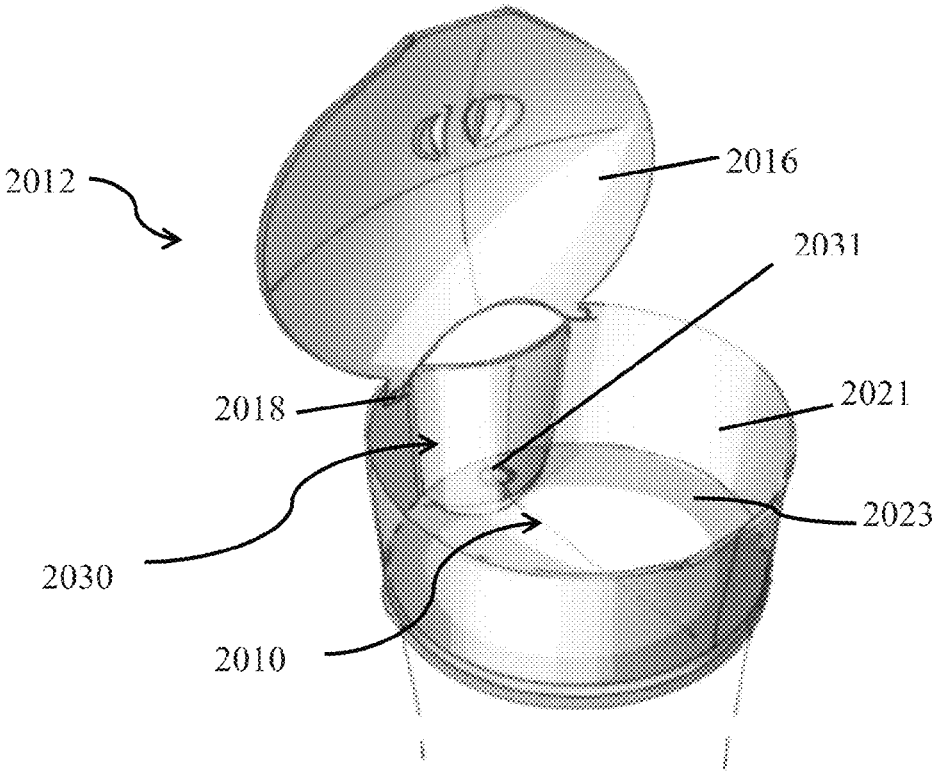

The embodiment of FIG. 20 of the combination snack and beverage unit 2012 includes a snack container 2010 with sidewall 2021, where sidewall 2021 curves inward to form a recession 2022, fencing off a beverage egress 2030. Beverage egress 2030 may include an orifice 2031 at floor 2023 allowing a straw to be inserted into the beverage portion (not shown). Lid 2016 has a pair of hinges 2018 positioned at each diametric opposite of recession 2022.

Figure 21:
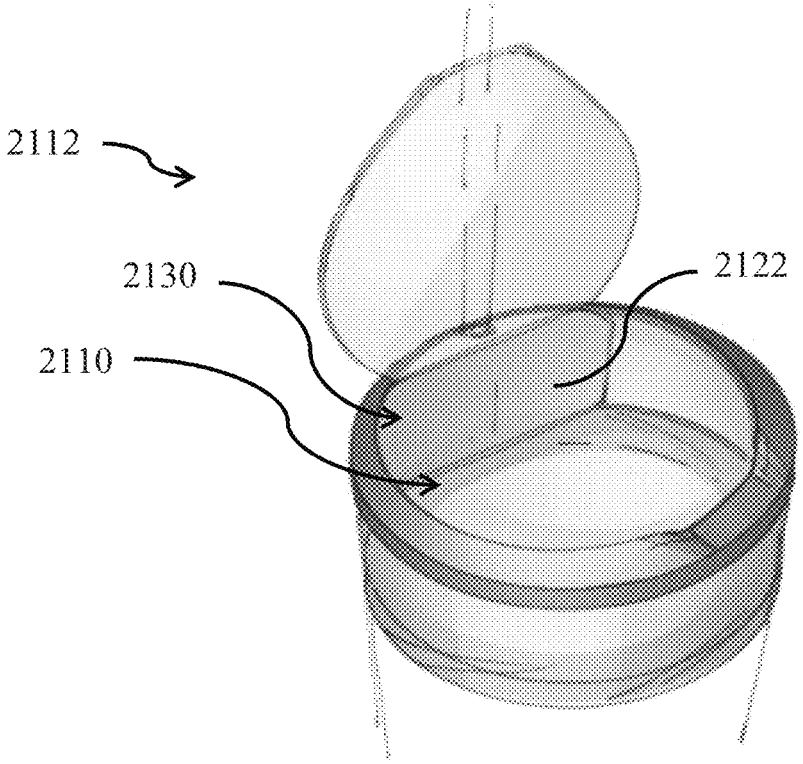

In the embodiment shown in FIG. 21 of the combination snack and beverage unit 2112, a beverage egress 2130 may be separated from the snack compartment 2110 by a partition 2122 to prevent intermixing of the beverage and food.

Figure 22:
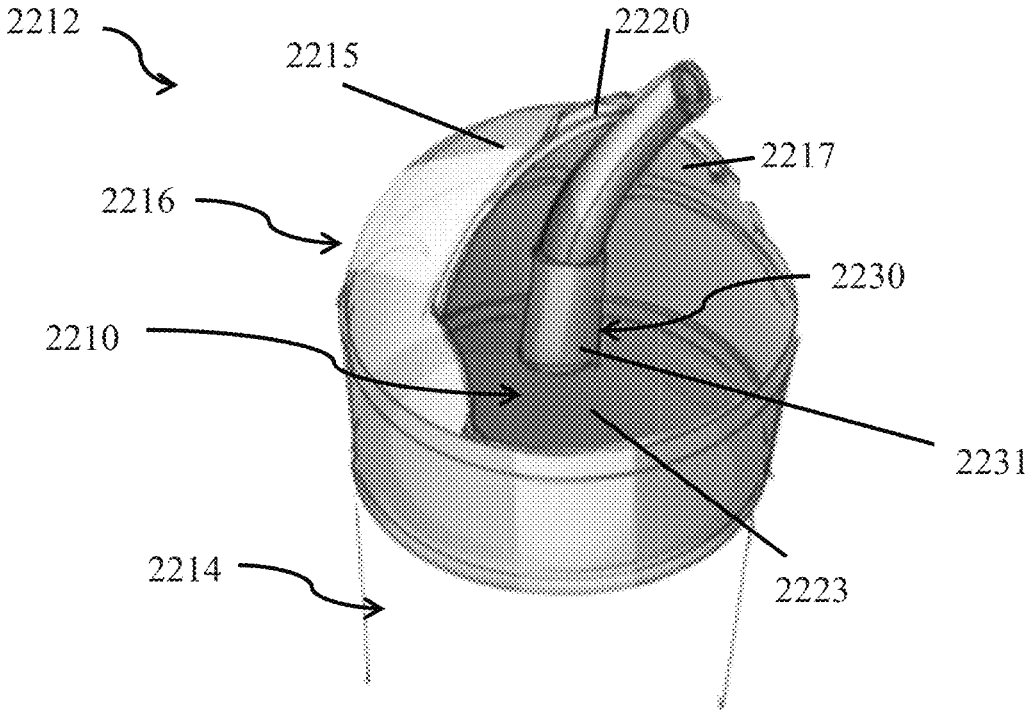
FIG. 22 is a perspective view of an alternate embodiment of a combination snack container and beverage container incorporated into a single unit in accordance with aspects of the present disclosure, having (vaulted) sliding lids depicted in an open position.

The embodiment shown in FIG. 22 of a combination snack and beverage unit 2212 includes a dome-shaped lid 2216, including a fixed first portion 2215 of the dome, and a sliding second portion 2217 of the dome, which rotationally sides to overlap the fixed portion 2215 and create an opening to the interior of snack container 2210. Second sliding portion 2217 is rotationally slidable to complete and close the domed lid 2216. Second sliding portion 2217 may include flange 2220 at a peripheral edge to allow the user to more easily manipulate movement of the second sliding portion 2217. A beverage egress 2230 includes a channel 2231 extending from the floor 2223 partway into snack container 2210, to allow for a straw insertion and fluid communication with beverage container 2214 while preventing intermixing with the snack container 2210.

Figure 23:
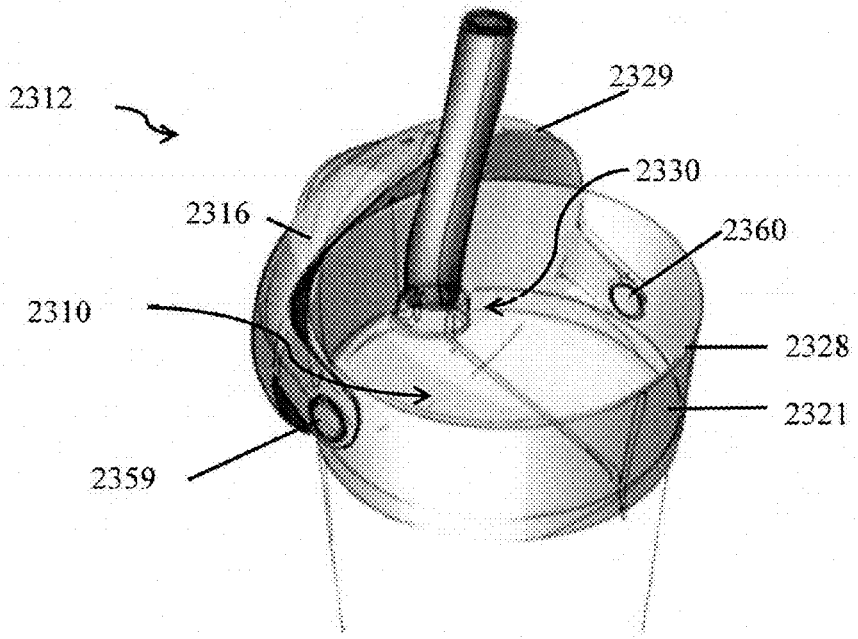
FIG. 23 is a perspective view of an alternate embodiment of a combination snack container and beverage container in accordance with aspects of the present disclosure, having a hinged lid depicted in an open position.

The embodiment shown in FIG. 23 of a combination snack and beverage unit 2312 depicts a snack container 2310 including sidewall 2321 and a domed lid 2316, where the domed lid 2316 includes a lid rim 2329 that engages with a rim 2328 of sidewall 2321. Domed lid 2316 may be flipped off entirely from snack container 2310 via one or more hinged arms 2359, rotated about a circle pivot 2360 on sidewall 2321. A beverage egress 2230 allows for fluid communication with beverage container 2214 while preventing intermixing with the snack container 2210.

Figure 24:
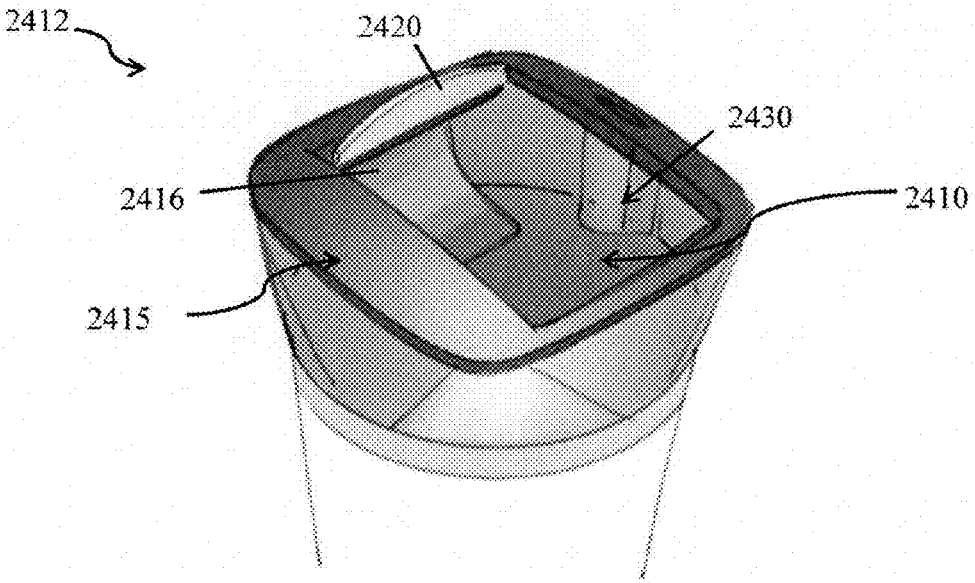
FIG. 24 is a perspective view of an alternate embodiment of a combination snack container and beverage container in accordance with aspects of the present disclosure, having a sliding lid depicted in an open position.

FIG. 24 is an embodiment of a combination snack container and beverage container 2412 having a sliding door 2416 on a portion of the lid 2415, depicted in an open position. Sliding door 2416 may be slightly curved, made of a rigid or flexible material, and slidable into snack container 2410 to create an opening in the lid 2415 for accessing snack container 2410. A tab 2420 on the periphery of door 2416 helps the user manipulate door 2416 to an open or closed position. A beverage egress 2430 allows for fluid communication with beverage container 2414 while preventing intermixing with the snack container 2410.

Any combination of the above lid styles and beverage egresses may be employed in a combination snack and beverage unit having the aspects of the disclosure.

Figure 25A:
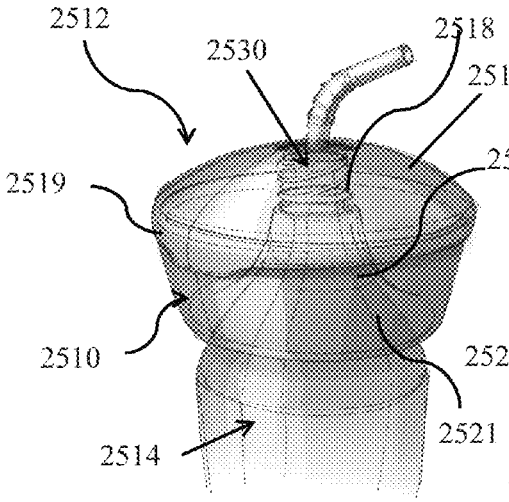
FIG. 25*a* and FIG. 25*b* is a perspective view of an alternate embodiment of a combination snack container, in conjunction with a beverage container of an enclosed bottle.
Figure 25B:
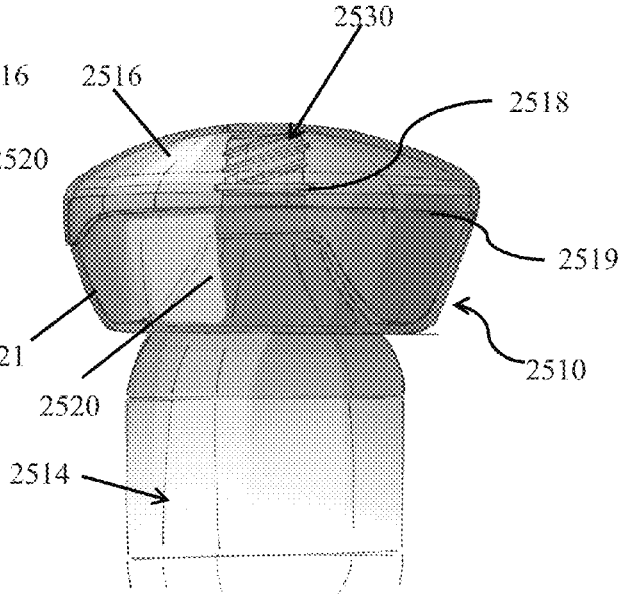

FIG. 25*a* and FIG. 25*b* are perspective views of an alternate embodiment of a combination snack and beverage unit, in use with a beverage container of an enclosed bottle. A doughnut shaped snack container 2510 includes an outer wall 2521, an inner wall 2520 shaped to fit the neck of a bottle 2514, and a removable lid 2516. Lid 2516 includes an outer rim 2519 and an inner rim 2518 shaped to engage with the outer wall 2521 and the inner wall 2520 of the snack container 2510. The outer portion of the inner wall 2520 forms a beverage egress 2530 for the bottle, sealed off from the snack container 2510.

Figure 26:
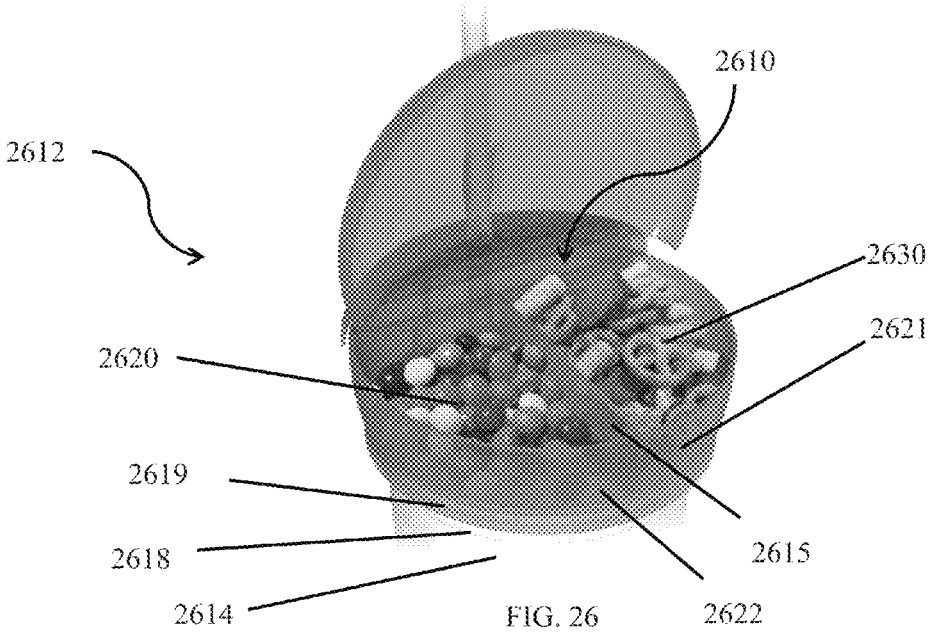
FIG. 26 is a perspective view of an alternate embodiment of a combination snack and beverage unit including a divider separating a first snack portion and a second snack portion.

The embodiment shown in FIG. 26 of a combination snack and beverage unit 2612 may attach to a beverage unit 2614 by respective corresponding threaded rims 2619 and 2618. Combination unit 2621 includes a sidewall 2621 and floor 2622. Divider 2615 separates the snack portion 2610 into a first snack portion 2620 and a second snack portion 2630.

Figure 27:
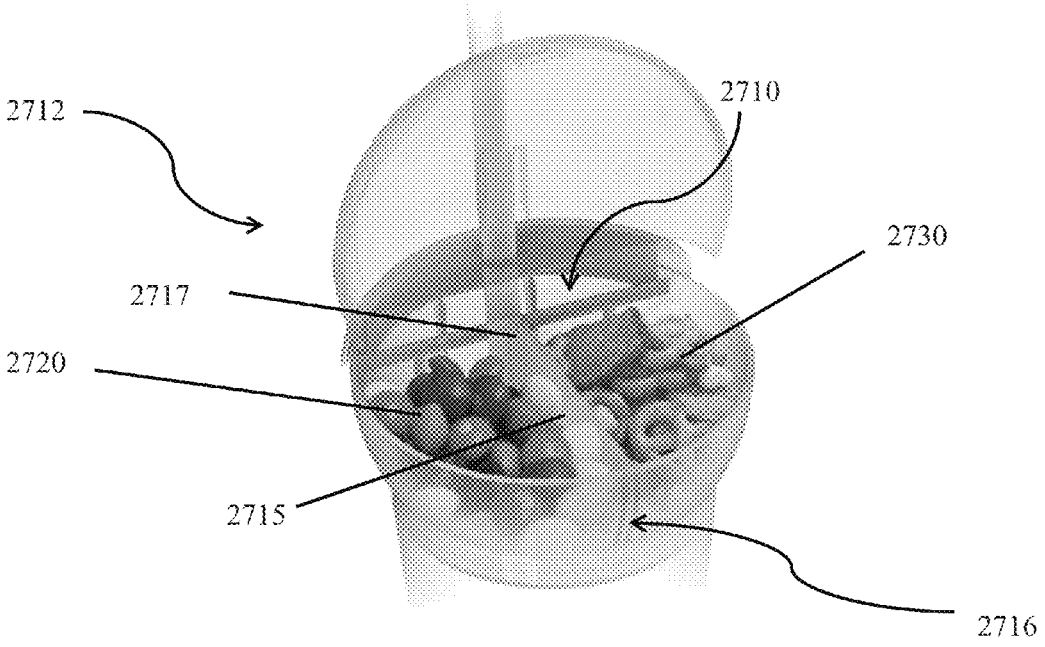
FIG. 27 is a perspective view of an alternate embodiment of a combination snack and beverage unit including a divider that is removable.

The embodiment shown in FIG. 27 of a combination snack and beverage unit 2712 includes a divider 2715 that is removable. Divider 2715 may be inserted into combination unit 2712 by sliding at least one edge into slots 2716 and 2717, to devise a single snack portion 2710 into two smaller portions, a first snack portion 2720 and a second snack portion 2730.

Figure 28:
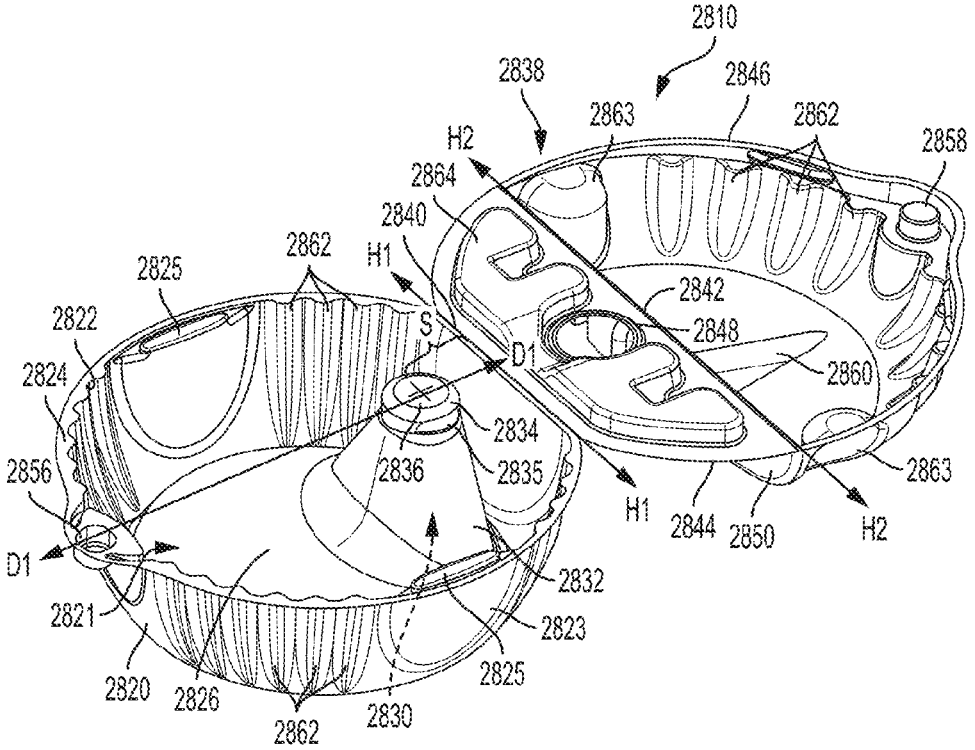
FIG. 28 is a perspective view of another alternate embodiment of the current disclosure shown in an as-molded/stacked/shipped orientation.

FIGS. 28-31 illustrate another exemplary embodiment of a beverage cup lid 2810 according to the current disclosure. This exemplary beverage cup lid 2810 is a unitary component of a thin (preferably, but not necessarily, less than 1 mm thick) material that has sufficient rigidity to maintain structural integrity but sufficient flexibility to allow for the living hinge and friction fit functionalities described below. In the thermoformed embodiment, the material is preferably between 0.10 mm and 0.25 mm thick; and in an even more particular embodiment, is set at 0.175 mm thick. Non-limiting examples of suitable materials for use with the current embodiment include a thermoformed plastic material, molded plastic or resin material or a formed or molded paperboard material (or any composites of the same). Examples of suitable molding include blow-molding. Non-limiting examples of plastic materials for use in any of the embodiments may include PET (polyethylene terephthalate) and/or recycled PET materials and/or polyproplylene #5 plastic materials. In an embodiment, the lid 2810 is designed to be disposable (i.e., single-use), but it is also within the scope of the disclosure that the lid 2810 may be designed for re-use as well. As shown in FIG. 28, the lid 2810 may be thermoformed as a single unit and designed to be nested together with other such lids for storage/shipping (FIG. 28 represents the thermoformed/nesting orientation).

Figure 31:
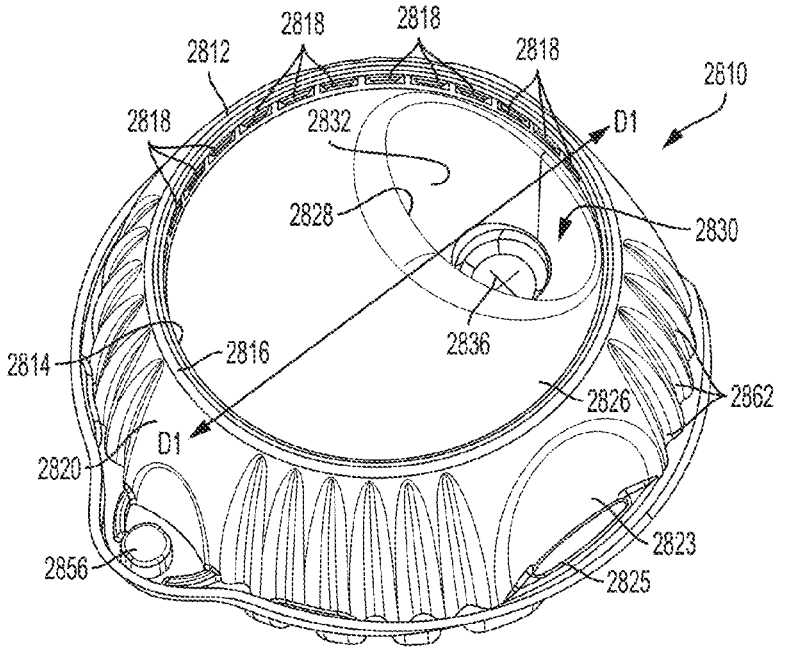
FIG. 31 is a perspective view of the embodiment of FIGS. 28-30 showing an underside of the embodiment.
Figure 33:
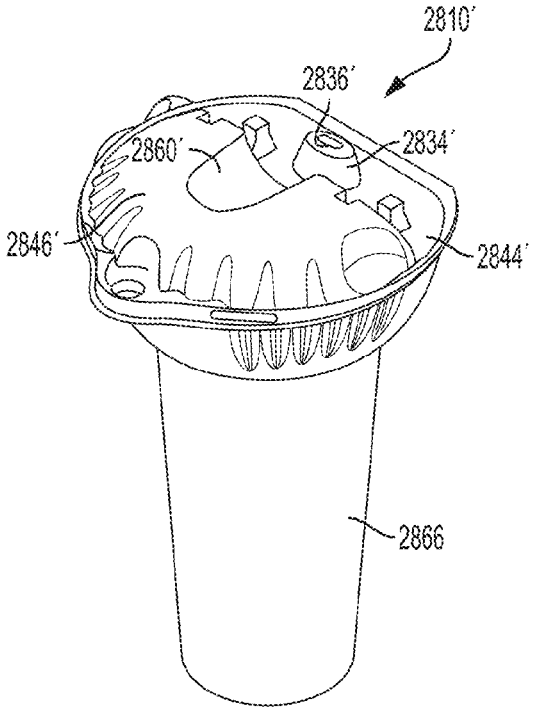
FIG. 33 is a perspective view of the embodiment of FIG. 32 shown seated on a drinking cup.
Figure 34:
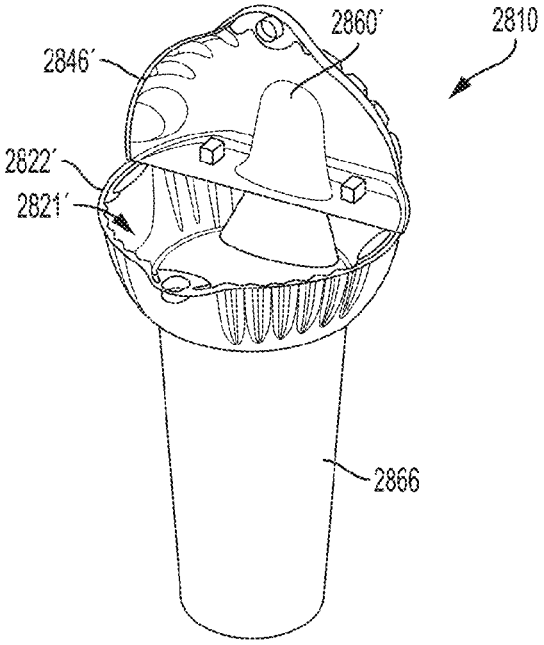
FIG. 34 is a perspective view of the embodiment of FIG. 32-33 shown seated on a drinking cup and in which a segment is pivoted to allow access to the snack/food reservoir.

Referring first to FIG. 31, which shows the underside of the beverage cup lid 2810, a radial collar 2812 is configured to engage with a rim of a drinking cup mouth (not shown, but see FIGS. 33 and 34 for a similar embodiment seated on a drinking cup). The radial collar 2812 includes an inner radial surface 2814 and an outer radial surface 2816. In an embodiment, the inner radial surface 2814 has an axial height that is equal to or larger than an axial height of a beaded rim of a drinking cup mouth, and the radial collar includes one or more radially inwardly extending protrusions 2818 for engaging with an under surface of a beaded rim of a drinking cup mouth to form a friction fit therebetween. In an embodiment, the protrusions 2818 are uniformly distributed about the circumference of the inner radial surface 2814.

Figure 30:
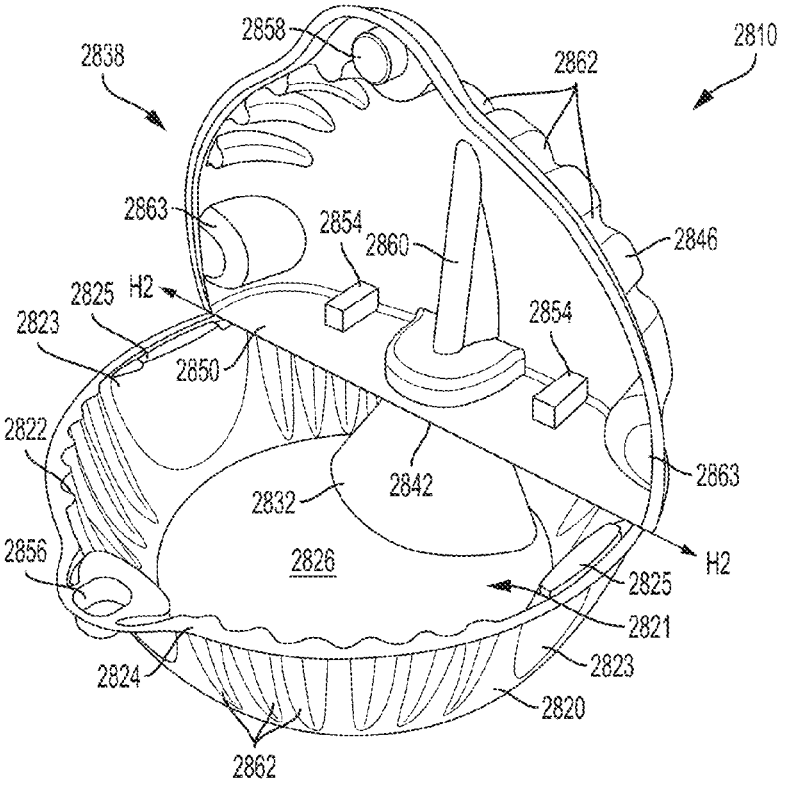
FIG. 30 is a perspective view of the embodiment of FIGS. 28 and 29 shown in an orientation in which a segment is pivoted to provide access to a snack/food reservoir.

Referring now to FIGS. 28, 30 and 31, an outer reservoir wall 2820 extends axially upward from the outer surface of the radial collar 2812 and encloses a reservoir chamber 2821 above the radial collar 2812. The outer reservoir wall includes an upper rim 2822 with at least one radially inwardly or outwardly extending flange. In the current embodiment, the upper rim 2822 includes a radially outwardly extending flange 2824 extending circumferentially about a portion of the upper rim 2822 (the portion that does not include the first living hinge as will be discussed below). A reservoir floor 2826 extends radially inward from an upper end of the inner surface 2814 of the radial collar 2812 and substantially closes the reservoir chamber 2821 from below the reservoir floor 2826. The floor 2826 includes a fluid path entrance opening 2828 (see FIG. 31) providing at least part of a fluid path 2830 extending upward through the reservoir chamber 2821. The fluid path opening 2828 is positioned along a first diametrical line D1-D1 extending through the cup 2810. As can be seen best in FIG. 31, the plane of the floor 2826 is positioned above the protrusions 2818 so that the floor will not extend down into the drinking cup (and into the fluid contents of the drinking cup) when the lid 2810 is seated on a beaded rim of a drinking cup mouth.

Referring now to FIG. 28, an inner wall 2832 separates the fluid path 2830 from the reservoir chamber 2821. The inner wall 2832 in current embodiment is substantially in the shape of an upside-down funnel extending upward from the floor 2826, where the upside-down funnel has a minor diameter (i.e., spout) 2834 extending above a vertical level of the upper rim 2822 of the outer reservoir wall 2820. As shown if FIGS. 28 and 31, the fluid path 2830 extends upward through the upside-down funnel wall 2832 and terminates at an x-shaped straw cutout 2836 at the spout 2834 (also at the top of the fluid path 2830).

Figure 29:
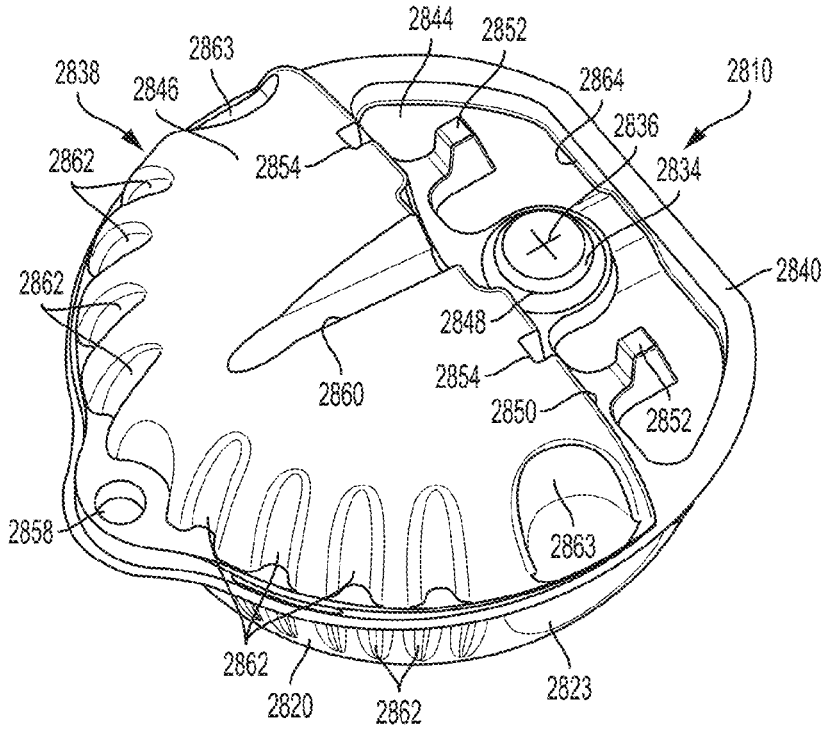
FIG. 29 is a perspective view of the embodiment of FIG. 28 shown in a closed orientation.

Referring to FIGS. 28-30, the lid 2810 includes a cap 2838 connected to the upper rim 2822 of the outer reservoir wall 2820 along a first living hinge 2840 having a first hinge axis H1-H1 that is perpendicular to the first diametrical line D1-D1. The first hinge axis H1-H1 is positioned a first distance S from a center the spout 2834 of the fluid path 2830. The cap 2838 further includes a second living hinge 2842 having a second hinge axis H2-H2 running parallel to the first hinge axis H1-H1 and positioned distal from the first hinge axis H1-H1 at a distance greater than the first distance S. The second hinge axis H2-H2 separates a fluid path segment 2844 of the cap 2838 from a reservoir segment 2846 of the cap 2838.

As shown in FIGS. 29 and 30, the fluid path segment 2844 of the cap 2838 is designed to pivot on living hinge 2842 to be seated over the upper rim 2822. The fluid path segment 2844 includes a fluid path hole 2848 that is positioned to be coaxial with the fluid path spout 2834 when the fluid path segment is pivoted to seat on the upper rim 2822 (i.e, the fluid path hole 2848 is on the first diametrical line D1 having a center at a distance S from the first hinge axis H1). The fluid path hole 2848 has a diameter slightly less than a diameter of the fluid path spout 2834 so that the fluid path spout 2834 is friction fit within the fluid path hole 2848 when the fluid path segment 2844 is pivoted to seat on the upper rim 2822. Further, spout 2834 may include one or more undercuts 2835 to engage with the fluid path hole 2848 when the hole 2843 passes the top of the spout 2834. As such, the engagement between the fluid path hole 2848 and the spout 2834 provides a friction fit coupling that retains the fluid path segment 2844 of the cap 2838 and the second living hinge 2842 over the upper rim 2822, and retains the fluid path hole 2848 over the fluid path 2830 when the fluid path segment 2844 is closed onto the upper rim 2822. When the fluid path segment 2844 of the cap 2838 is retained on the upper rim 2822 in such a manner, the reservoir segment 2846 of the cap 2838 can pivot on the second living hinge 2842 to selectively provide access to the reservoir chamber 2821 thereunder. For example, FIG. 29 depicts the reservoir segment 2846 pivoted down onto the upper rim 2822 in a closed position (closing off access to the reservoir chamber 2821) and FIG. 30 depicts the reservoir segment 2846 pivoted up at substantially ninety degrees (for the purposes of the present disclosure the range of 80 to 100 degrees is substantially ninety degrees) in an open position (allowing access to the reservoir chamber 2821).

In the current embodiment, the reservoir segment 2846 of the cap 2838 is substantially domed where the dome has a substantially vertical wall 2850 extending along the second hinge axis H2 (the wall 2850 is vertical when in the closed position as shown in FIG. 29). Thus, when pivoted to the open position as shown in FIG. 30, the vertical wall 2850 seats onto the reservoir segment 2846 of the cap 2830. The reservoir segment 2846 includes a pair of rectangular posts 2852 positioned on opposite sides of fluid path hole 2848 and aligned with a corresponding pair of rectangular cutouts (indentions) 2854 in the wall 2850 so as to be received within the cutouts 2854 when the reservoir segment is pivoted to its open position as shown in FIG. 30. The lateral dimensions of the rectangular posts 2852 are slightly larger than those of the cutouts 2854 to provide a friction fit between the posts 2852 and the cutouts 2854 when the reservoir segment 2846 is pivoted to its open position.

The flange 2824 extending from the upper rim 2822 includes a downwardly extending cylindrical hole 2856 positioned along the first diametrical line D1-D1 and the reservoir segment 2846 of the cap 2838 also includes a corresponding cylindrical post 2858 that extends downward into the cylindrical hole 2856 when the reservoir segment 2846 is pivoted to its closed position as shown in FIG. 29. In the current embodiment, the cylindrical post 2858 has a slightly larger diameter than that of the cylindrical hole 2856 to provide a friction fit coupling between the two when the two are pressed together.

In the current embodiment, the top of the domed reservoir segment 2846 includes a c-shaped cutout (indention) 2860 extending from the vertical wall 2850 and extending for a distance along first diametrical line D1-D1. As shown in FIG. 30, when the reservoir segment 2846 is pivoted to its open position, the c-shaped cutout 2860 is substantially vertical and coaxial with the fluid flow path 2830. Consequently any drinking straw (not shown) extending from the spout 2834 may be received within the c-shaped cutout. In an embodiment, the diameter of the c-shaped cutout is slightly less than that of the ordinary drinking straw so as to provide a friction fit coupling between the c-shaped cutout and the drinking straw.

In an embodiment, the top of the domed reservoir segment 2846 may also include one or more punch-holes (not shown) for venting the reservoir chamber 2821 (e.g., to allow steam from food contained in the reservoir chamber 2821 to be vented therethrough). It is also within the scope of the current disclosure that vent holes (such as the punch-holes) be positioned in other parts of the lid 2810.

In an embodiment, the lid 2810 may also be designed with various indentions and the like to improve structural integrity, especially in the thermoformed embodiment. For example, rib-like indentions 2862 may be distributed circumferentially about the outer reservoir wall 2820 and/or about the domed wall of the reservoir segment 2846. Similarly, the fluid path segment 2844 of the cap 2838 may include one or more cutouts (indentions) 2864 surrounding structural components such as posts 2852 and hole 2848 to add to the structural integrity of the segment 2844 and those components. Some indentations may serve multiple purposes. For example, diametrically opposed semi-cylindrical indentions 2863 positioned on opposing lateral sides of the domed reservoir segment 2846 may be shaped and sized to be adapted for use as finger grips. Likewise, corresponding diametrically opposed flats 2823 may be positioned on opposing lateral sides of the outer reservoir wall 2820 such that they are positioned below the finger grip indentations 2863 when the domed reservoir segment 2846 is closed onto the rim 2822. The flats 2823 may include bumpers 2825 approximate the rim 2822 capping the flat segments 2823. Understanding that a user may be using the finger grip indentations 2863 for pressing the domed reservoir segment 2846 down closed against the rim 2822, the flats 2823 and bumpers 2825 add additional structural support to the outer reservoir wall 2820 below the finger grip indentations 2863 so that the outer reservoir wall will less prone to crumpling when pressure is applied down on the rim 2822 in the area of the finger grip indentations 2863.

Figure 32:
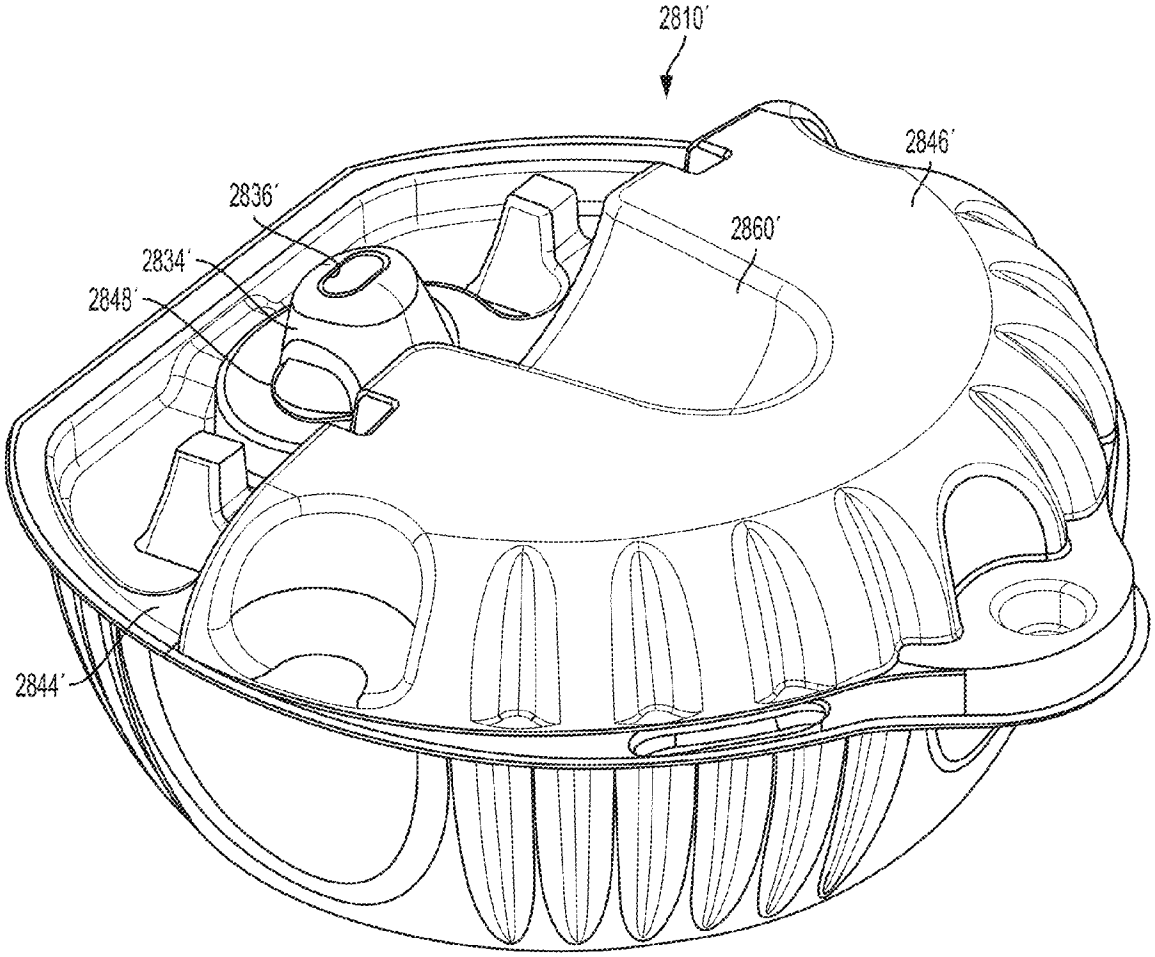
FIG. 32 is a peispeelive view of an embodiment similar to the embodiments of FIGS. 28-31 in a closed orientation.

FIGS. 32-34 show an alternate embodiment of the lid 2810' which is substantially identical to the embodiment of the lid 2810 illustrated in FIGS. 28-31, except for the components discussed as follows. In the embodiment of FIGS. 32-34, the spout 2834' extends vertically upward and includes a drinking hole 2836' in place of the straw cutout. With such a design, the user may place the spout 2834' to the user's lips and drink directly from the spout 2834'. Additionally, in this embodiment, the c-shaped cutout is replaced with a deeper cutout 2860' allowing the user's nose to be received within while drinking from the spout 2834' (in other words, the user's nose is not being smashed against the domed reservoir segment 2846' when drinking from the spout 2834' when the reservoir segment 2846' is in the open position as shown in FIG. 34.

FIGS. 33 and 34 illustrate the lid 2810' seated on a drinking cup, such as a disposable drinking cup 2866 used in most fast-food restaurants and/or coffee shops (having a rim diameter of 3-4 inches for 14-26 oz. drinking cups; 4-5 inches for 28-34 oz. drinking cups and 4.25-5.25 inches for 40-64 oz. drinking cups). In FIG. 33, the reservoir segment 2846' is in its closed position and in FIG. 34, the reservoir segment 2846' is in its open position allowing access to any snacks, food or other contents contained within the reservoir chamber 2821'.

It should be apparent to those of ordinary skill that there are many variations available to embodiments of FIGS. 28-34 without departing from the scope of the current disclosure. For example, the friction fit couplings disclosed herein, may be replaced with other forms of couplings such as latches, adhesive and the like. Additionally, with the friction fit couplings disclosed herein, such couplings can be moved to various other components. For example, the friction fit coupling that retains the fluid flow segment 2844/2844' against the rim 2822/2822' may be located at the rim 2822/2822' rather than between the spout 2834/2834' and the hole 2848/2848'. As another example, the cylindrical post 2858 and corresponding cylindrical cutout 2856 may be switched around, or this friction fit coupling may be moved to another part or to multiple parts of the rim 2822.

Another type of variation that will be apparent to those of ordinary skill is the design of the spout 2834/2834' depending upon the type of drinking that the lid is designed to accommodate. For example, the spout 2834' may be replaced with a spout that is shaped like the spout of a beer or soft-drink bottle.

Another type of variation that will be apparent to those of ordinary skill is the design of the reservoir chamber, depending upon the type of foods, snacks or other contents indented to be dispensed therefrom. For example, the reservoir chamber 2821/2821' may be divided into one or more sub-chambers, separated by inner walls.

Another type of variation can be the shape and/or size of the wall 2832. Additionally, the radial collar 2812 may be in another form. For example, the radial collar 2812 may have a threaded inner surface adapted to mate with a correspondingly threaded mouth of a drinking cup (such as a mason jar). As another example, the radial collar 2812 may be sized to couple to a rim of an aluminum can (such as a beer can or soda can).

Another type of variation within the scope of the disclosure is that the lid 2810 may be designed as a stand-alone component (i.e., not necessarily adapted to be seated onto any drinking cup, can or bottle). In such an embodiment, the radial collar 2812 may be less prominent as it is not designed to seat onto anything, and the inner wall 2832 defining the fluid path 2830 may also not be present.

It is also within the scope of the disclosure that CPG companies may pre-fill the lids 2810/2810' (or any of the other embodiments disclosed herein) with foods/snacks and sell the pre-filled lids separately (in packages containing one or more of the pre-filled lids 2810/2810') from the cups 2866 or other fluid receptacles on which the lids 2810/2810' may be adapted to be seated upon.

The many features and advantages of the disclosure are apparent from the detailed specification, and, thus, it is intended by the appended claims to cover all such features and advantages of the disclosure which fall within its true spirit and scope. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. A lid for a beverage cup comprising:

a radial collar configured to engage with a rim of a drinking cup mouth, having an inner radial surface and an outer radial surface;

an outer reservoir wall extending axially upward from the outer surface of the radial collar and enclosing a reservoir chamber above the radial collar, and including an upper rim;

a reservoir floor extending radially inward from an upper end of the inner surface of the radial collar and substantially closing the reservoir chamber from below the reservoir floor, the floor including a fluid path opening providing at least part of a fluid path extending upward through the reservoir chamber, the fluid path opening being positioned along a first diametrical line extending through the reservoir chamber;

an inner wall separating the fluid path from the reservoir chamber; and a cap connected to the upper rim of the outer reservoir wall along a first living hinge having a first hinge axis positioned a first distance S from a center the fluid path opening, the cap further including a second living hinge having a second hinge axis running parallel to the first hinge axis and positioned distal from the first hinge axis at a distance greater than the first distance S, the second hinge axis separating a fluid path segment of the cap from a reservoir segment of the cap;

wherein the fluid path segment of the cap includes a fluid path hole, at least part of which is on the first diametrical line and at a distance S from the first hinge axis; and wherein the fluid path segment of the cap includes a coupling that retains the fluid path segment of the cap and the second living hinge over the upper rim, and retains the fluid path hole over the fluid path when the fluid path segment of the cap is closed onto the upper rim;

whereby, when the fluid path segment of the cap is retained on the upper rim, the reservoir segment of the cap can pivot on the second living hinge to selectively provide access to the reservoir chamber thereunder.

2. The lid of claim 1, wherein the inner radial surface has an axial height that is equal to or larger than an axial height of a beaded rim of a drinking cup mouth.

3. The lid of claim 1, wherein the radial collar includes one or more radially inwardly extending protrusions for engaging with an under surface of a beaded rim of a drinking cup mouth to form a friction fit there-between.

4. The lid of claim 1, wherein the upper rim includes at least one radially inwardly or outwardly extending flange.

5. The lid of claim 1, wherein the inner wall is substantially in the shape of an upside-down funnel extending upward from the floor.

6. The lid of claim 5, wherein the upside-down funnel has a minor diameter extending above a vertical level of the upper rim of the outer reservoir wall to form a spout.

7. The lid of claim 6, wherein the spout has a diameter sufficient to provide a friction fit with the fluid path hole when the spout is received within the fluid path hole.

8. The lid of claim 5, wherein the spout includes an x-shaped cutout for receiving a drinking straw therethrough.

9. The lid of claim 5, wherein the spout includes a drinking hole at a top surface thereof.

10. The lid of claim 1, wherein the cap includes a friction fit coupling that retains the fluid path segment of the cap and the second living hinge over the upper rim.

11. The lid of claim 10, wherein the friction fit coupling includes the fluid path hole.

12. The lid of claim 11, wherein:

the inner wall is substantially in the shape of an upside-down funnel extending upward from the floor, having a minor diameter extending above a vertical level of the upper rim of the outer reservoir wall to form a spout; and the spout has a diameter sufficient to provide a friction fit coupling with the fluid path hole when the spout is received within the fluid path hole.

13. The lid of claim 1, wherein the first and second hinge axes are substantially perpendicular to the first diametrical line.

14. The lid of claim 1, wherein the reservoir segment of the cap includes at least one of a post and an indentation for providing friction fit coupling with a complimentary at least one of an indentation and post provided at the upper rim of the outer reservoir wall when the lid is pivoted down to a closed position.

15. The lid of claim 14, wherein the reservoir segment includes a cylindrical post for providing a friction fit coupling with a complimentary indentation provided on a flange extending from the upper rim of the outer reservoir wall.

16. The lid of claim 1, wherein the reservoir segment is pivotable, when the fluid path segment is retained on the upper rim, between (a) a closed position that is seated on the upper rim of the outer reservoir wall closing off the reservoir chamber there-beneath and (b) an open position in which the reservoir segment is positioned substantially perpendicular to the reservoir segment allowing access to the reservoir chamber.

17. A lid for a beverage cup comprising:

a radial collar configured to engage with a rim of a drinking cup mouth, having an inner radial surface and an outer radial surface;

an outer reservoir wall extending axially upward from the outer surface of the radial collar and enclosing a reservoir chamber above the radial collar, and including an upper rim;

a reservoir floor extending radially inward from an upper end of the inner surface of the radial collar and substantially closing the reservoir chamber from below the reservoir floor, the floor including a fluid path opening providing at least part of a fluid path extending upward through the reservoir chamber, the fluid path opening being positioned along a first diametrical line extending through the reservoir chamber;

an inner wall separating the fluid path from the reservoir chamber substantially in the shape of an upside-down funnel extending upward from the floor, having a minor diameter extending above a vertical level of the upper rim of the outer reservoir wall to form a spout; and a cap connected to the upper rim of the outer wall with a first living hinge and including a first segment with a hole adapted to receive the spout;

wherein the cap includes a second segment connected to the first segment by a second living hinge and adapted to be pivotable to selectively provide access to the reservoir chamber.

18. The lid of claim 17, wherein all the components are molded as a unitary thermoformed unit.

* * * * *